US008794464B2

(12) United States Patent
Yamauchi

(10) Patent No.: US 8,794,464 B2
(45) Date of Patent: Aug. 5, 2014

(54) ASSEMBLABLE AND DISASSEMBLABLE CONTAINER

(75) Inventor: Hisatoshi Yamauchi, Mizuho (JP)

(73) Assignee: Sanko Co., Ltd., Misuho-shi (JP)

( * ) Notice: Subject to any disclaimer, the term of this patent is extended or adjusted under 35 U.S.C. 154(b) by 0 days.

(21) Appl. No.: 13/371,606

(22) Filed: Feb. 13, 2012

(65) Prior Publication Data

US 2012/0223072 A1 Sep. 6, 2012

(30) Foreign Application Priority Data

Mar. 3, 2011 (JP) ..... 2011-045815

(51) Int. Cl.

| | |
|---|---|
| ***B65D 6/16*** | (2006.01) |
| ***B65D 6/24*** | (2006.01) |
| ***B65D 6/34*** | (2006.01) |
| ***B65D 90/08*** | (2006.01) |

(52) U.S. Cl.

CPC ..... *B65D 11/1873* (2013.01)

USPC ..... 220/4.28; 220/4.31; 220/325; 220/630; 220/682; 220/659; 220/690; 220/691; 217/12 R; 217/13; 217/43 R; 217/45

(58) Field of Classification Search

USPC ..... 220/4.31, 4.28, 625, 628, 630, 682, 220/656, 659, 690, 691; 217/12 R, 13, 43 R, 217/45

See application file for complete search history.

(56) References Cited

U.S. PATENT DOCUMENTS

| | | | | |
|---|---|---|---|---|
| 3,844,000 | A * | 10/1974 | Hedu | 24/615 |
| 3,967,351 | A * | 7/1976 | Rosenberg et al. | 24/616 |
| 4,375,265 | A * | 3/1983 | van de Wetering et al. | 220/1.5 |
| 5,816,425 | A * | 10/1998 | Keip et al. | 220/4.31 |
| 6,966,449 | B2 * | 11/2005 | Williams | 220/4.31 |
| 7,004,344 | B2 * | 2/2006 | Fulton et al. | 220/4.31 |
| 8,109,402 | B2 * | 2/2012 | Hartwall | 220/7 |
| 2009/0071956 | A1 * | 3/2009 | Lin | 220/4.31 |
| 2010/0018966 | A1 * | 1/2010 | Roberts et al. | 220/4.31 |

FOREIGN PATENT DOCUMENTS

JP 3-026129 U 3/1991

* cited by examiner

*Primary Examiner* — Fenn Mathew
*Assistant Examiner* — Jennifer Castriotta
(74) *Attorney, Agent, or Firm* — Westerman, Hattori, Daniels & Adrian, LLP

(57) ABSTRACT

An assemblable and disassemblable container is disclosed wherein a short wall member includes upper corner reinforcing members each formed at a corresponding corner formed by an upper horizontal flange and an endwise vertical side plate portion of the short wall member, and the upper corner reinforcing member includes an inclined coupling rib coupling the vicinity of the end of the upper horizontal flange to the vicinity of the upper end of the endwise vertical side plate portion, and wherein the lower end of the inclined coupling rib is positioned close to an endwise vertical side plate portion side of a lower horizontal rib of a horizontal portion included in a fitting block member. This configuration allows the short wall members and thus the container formed into a box shape to be increased in strength and rigidity, and can be prevented from undergoing torsional deformation.

5 Claims, 27 Drawing Sheets

1

ASSEMBLABLE AND DISASSEMBLABLE CONTAINER

FIELD OF THE INVENTION

The present invention relates to an assemblable and disassemblable container (hereinafter simply referred to as "a container") that can be assembled and then disassembled.

BACKGROUND OF THE INVENTION

An examined Japanese Utility Model Publication (Jikko-Hei) No. 3-26129 discloses a container configured such that in order to increase the height of a container main body that cannot be disassembled, an orifice frame shaped like a rectangular shell is placed on the container main body.

SUMMARY OF THE INVENTION

In the container disclosed in the examined Japanese Utility Model Publication (Jikko-hei) No. 3-26129, the container main body itself cannot be assembled or disassembled.

In the above-described orifice frame, a fitting protruding wall formed on a first support wall is fitted into a fitting recessed portion formed in a second support wall to couple the first and second support walls together. However, disadvantageously, the fitting protruding portion formed on the first support wall is insufficient in strength and may thus be damaged. The fitting protruding portion formed on the first support wall may also be damaged while coupled to the second support wall.

An object of the present invention is to solve the above-described problems with the container main body.

The container comprises one bottom member, a first set of two wall members, and a second set of two wall members and the container is assembled in such a manner that the two wall members of the first set lie opposite each other and that two wall members of the second set lie opposite each other, by fitting fitting blocks formed on an endwise vertical side plate portion of the wall member of the second set into fitting space portions formed in a vertically elongate coupling portion of the wall member of the first set, and furthermore, the first set of wall members and the second set of wall members are each coupled to the bottom member by fitting the fitting block members suspended from back surfaces of lower-end horizontal flanges of the wall member of the first set and the wall member of the second set into respective fitting vertical slots formed in the bottom member, and moreover, the wall member of the second set includes upper corner reinforcing members each formed at a corresponding corner formed by an upper horizontal flange and an endwise vertical side plate portion of the wall member of the second set, and additionally, the upper corner reinforcing member includes an inclined coupling rib coupling the vicinity of the end of the upper horizontal flange to the vicinity of the upper end of the endwise vertical side plate portion, and the lower end of the inclined coupling rib is positioned close to an endwise vertical side plate portion side of a lower horizontal rib of a horizontal portion included in the fitting block member.

Furthermore, a horizontal rib formed on the upper corner reinforcing member is arranged in a substantially collinear manner with respect to an upper horizontal rib of the horizontal portion formed on the corresponding fitting block member.

Moreover, horizontal ribs or corner horizontal reinforcing ribs formed on the wall member of the second set are each arranged in a substantially collinear manner with respect to an upper horizontal rib of the horizontal portion formed on the corresponding fitting block member.

Additionally, a viewing through-slot is formed in a vertical side plate portion of each of the vertically elongate coupling portions of the wall member of the first set so as to overlap the fitting space formed in the vertically elongate coupling portion. An end of each of the horizontal ribs formed on the wall member of the first set is arranged in abutting contact with the vertically elongate coupling portion positioned close to the corresponding viewing through-slot.

The container comprises the one bottom member, the first set of two wall members, and the second set of two wall members, and the container is assembled in such a manner that the two wall members of the first set lie opposite each other and that two wall members of the second set lie opposite each other, by fitting the fitting blocks formed on the endwise vertical side plate portion of the wall member of the second set into the fitting space portions formed in the vertically elongate coupling portion of the wall member of the first set, and furthermore, the first set of wall members and the second set of wall members are each coupled to the bottom member by fitting the fitting block members suspended from back surfaces of lower-end horizontal flanges of the wall member of the first set and the wall member of the second set into the respective fitting vertical slots formed in the bottom member, and moreover, the wall member of the second set includes the upper corner reinforcing members each formed at the corresponding corner formed by the upper horizontal flange and an endwise vertical side plate portion of the wall member of the second set. The upper corner reinforcing member includes the inclined coupling rib coupling the vicinity of the end of the upper horizontal flange to the vicinity of the upper end of the endwise vertical side plate portion. The lower end of the inclined coupling rib is positioned close to the endwise vertical side plate portion side of the lower horizontal rib of the horizontal portion included in the fitting block member. As a result, the second set of wall members and thus the container assembled into a box shape can be increased in strength and rigidity. Furthermore, the container can be prevented from undergoing torsional deformation.

Furthermore, the horizontal rib formed on the upper corner reinforcing member is arranged in a substantially collinear manner with respect to the upper horizontal rib of the horizontal portion formed on the corresponding fitting block member. Thus, the container can be increased in strength and rigidity and be prevented from undergoing torsional deformation. The fitting block members can also be increased in strength and rigidity.

Moreover, the horizontal ribs or corner horizontal reinforcing ribs formed on the wall member of the second set are each arranged in a substantially collinear manner with respect to the upper horizontal rib of the horizontal portion formed on the corresponding fitting block member. As a result, the second set of wall members and thus the container assembled into a box shape can be increased in strength and rigidity. Furthermore, the container can be prevented from undergoing torsional deformation. The fitting block members can also be increased in strength and rigidity.

Moreover, the viewing through-slot is formed in the vertical side plate portion of each of the vertically elongate coupling portions of the wall member of the first set so as to overlap the fitting space formed in the vertically elongate coupling portion, and the end of each of the horizontal ribs formed on the wall member of the first set is arranged in abutting contact with the vertically elongate coupling portion positioned close to the corresponding viewing through-slot. As a result, the vertical coupling portion positioned close to the viewing through-slot and thus the first set of wall members can be increased in strength and rigidity.

DETAILED DESCRIPTION OF THE PREFERRED EMBODIMENTS

An embodiment of the present invention will be described below. However, the present invention is not limited to this embodiment, and any other embodiment is possible unless such an embodiment departs from the spirits of the present invention.

Figure 1:
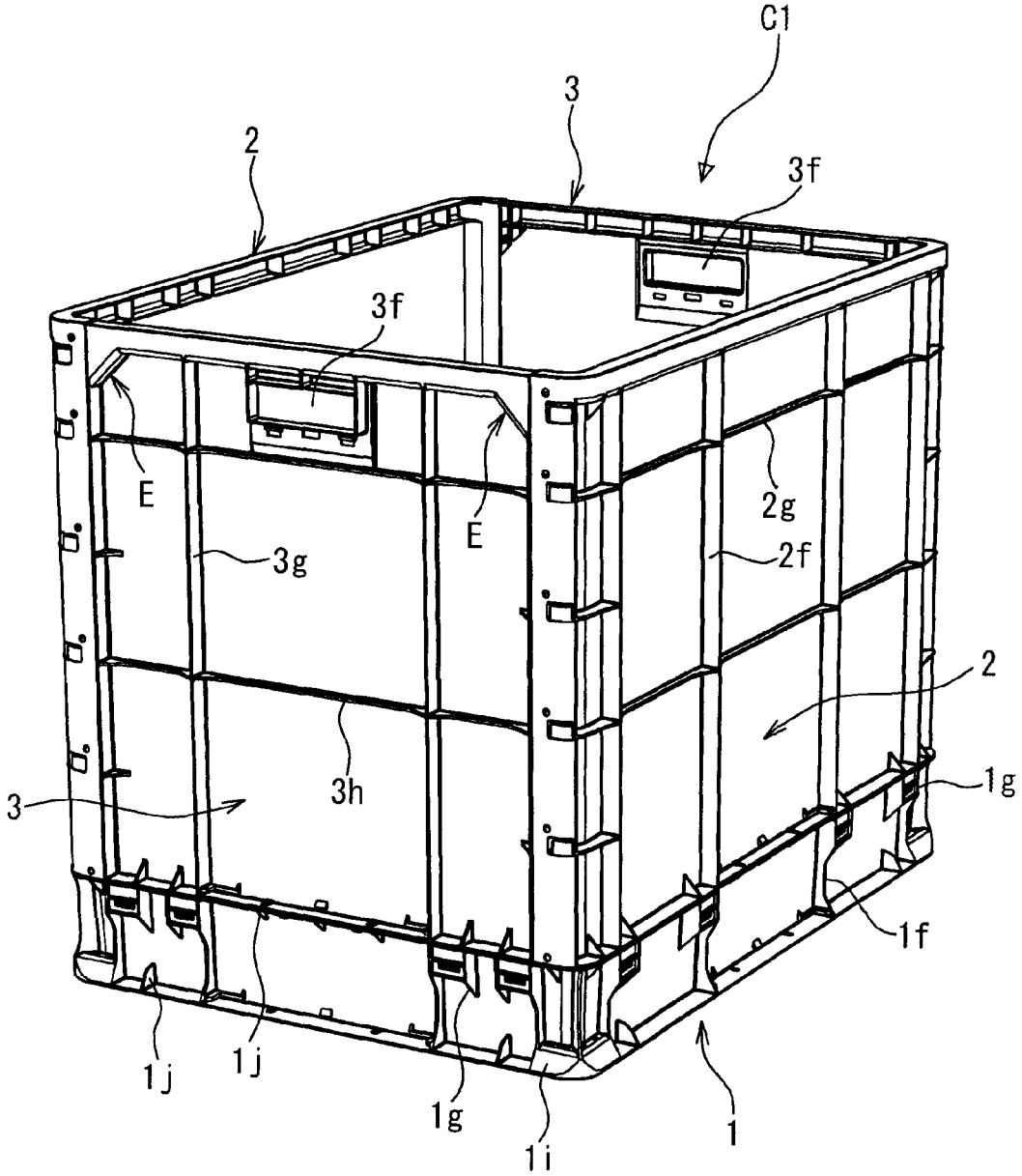
FIG. 1 is a perspective view showing that an assemblable and disassemblable container according to the present invention has been assembled.

In FIG. 1, an assemblable and disassemblable container (as mentioned above, hereinafter simply referred to as "a container") is denoted by C1 and includes a bottom member 1, opposite long wall members 2, and opposite short wall members 3.

Figure 2:
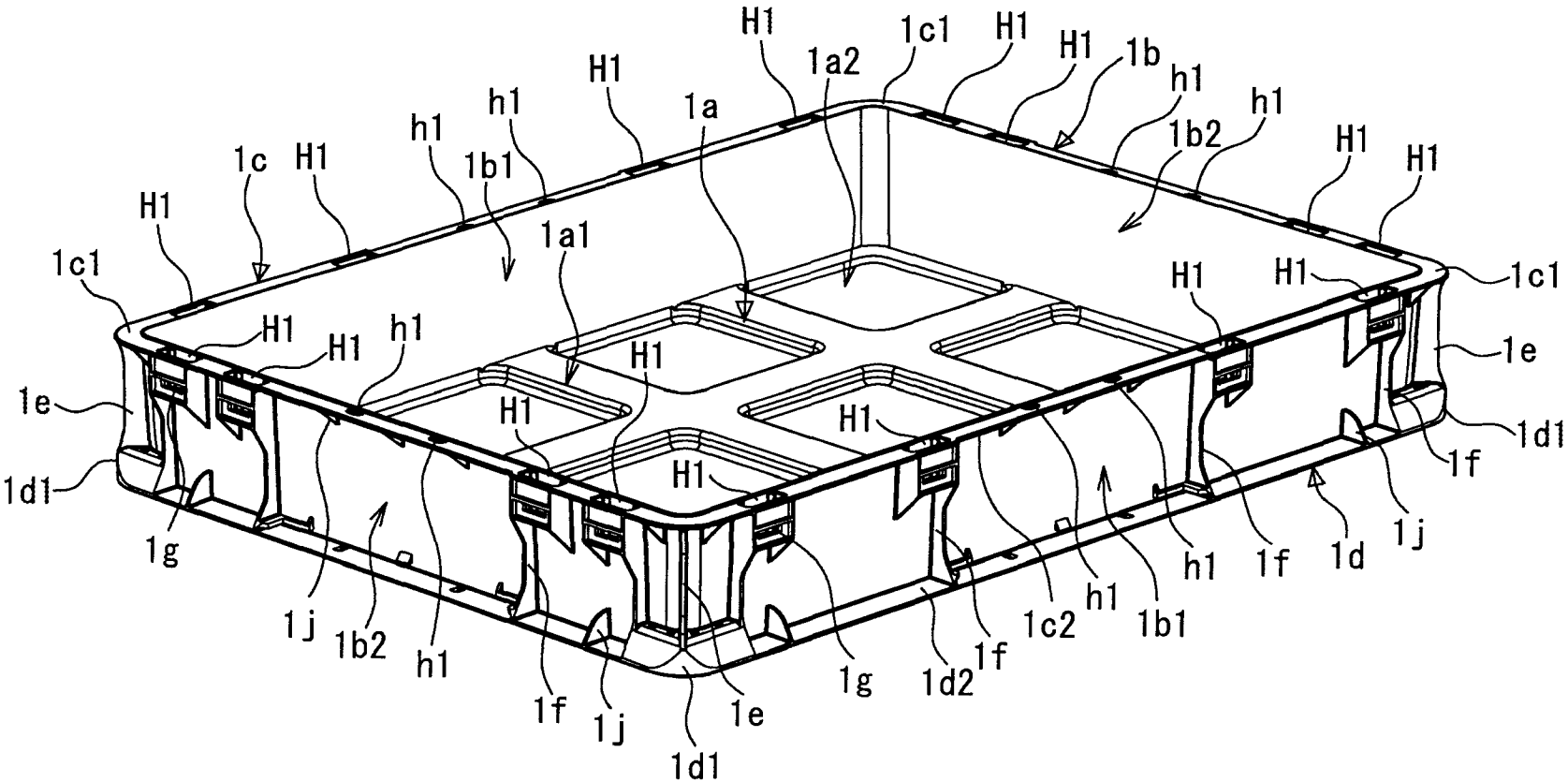
FIG. 2 is a perspective view of a bottom member included in the container according to the present invention.
Figure 3:
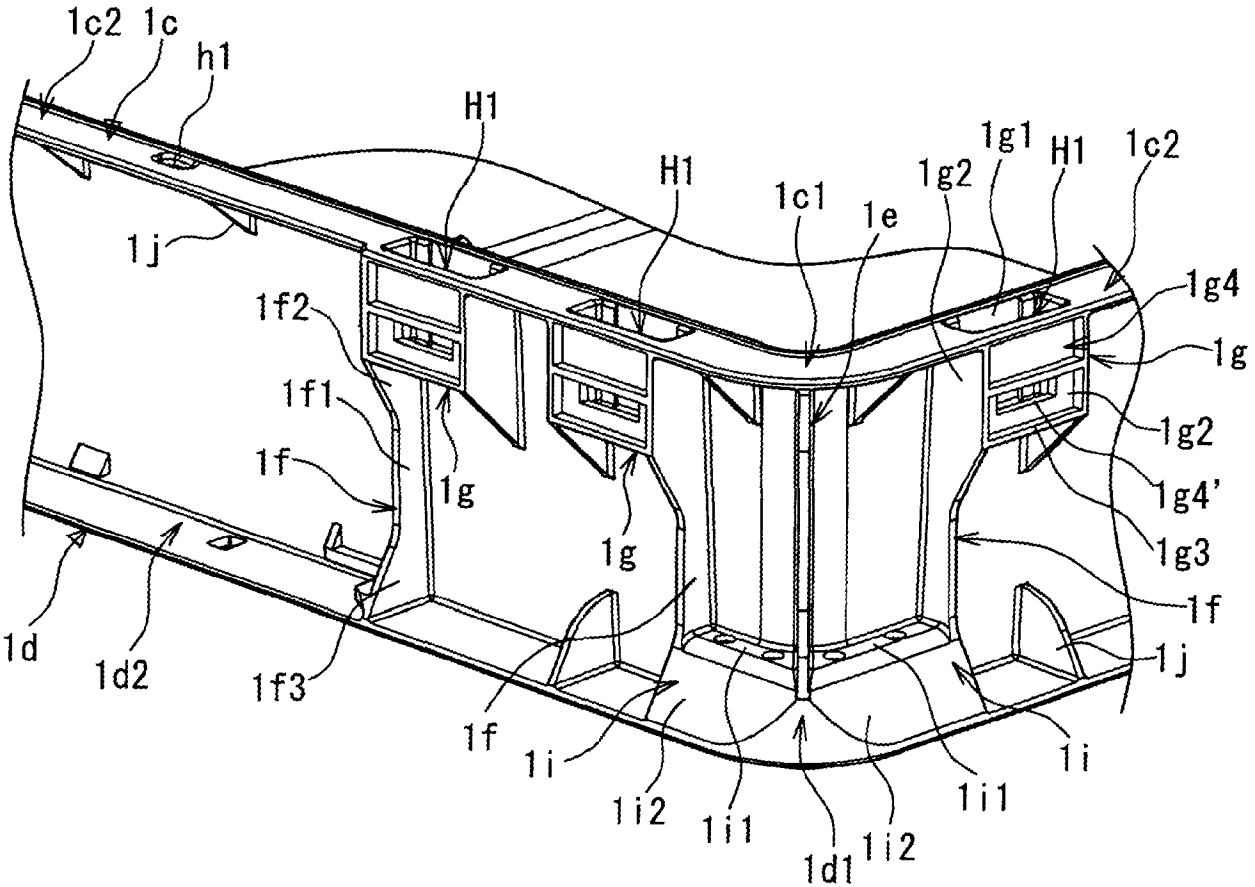
FIG. 3 is a partly enlarged perspective view of the bottom member shown in FIG. 2.
Figure 4:
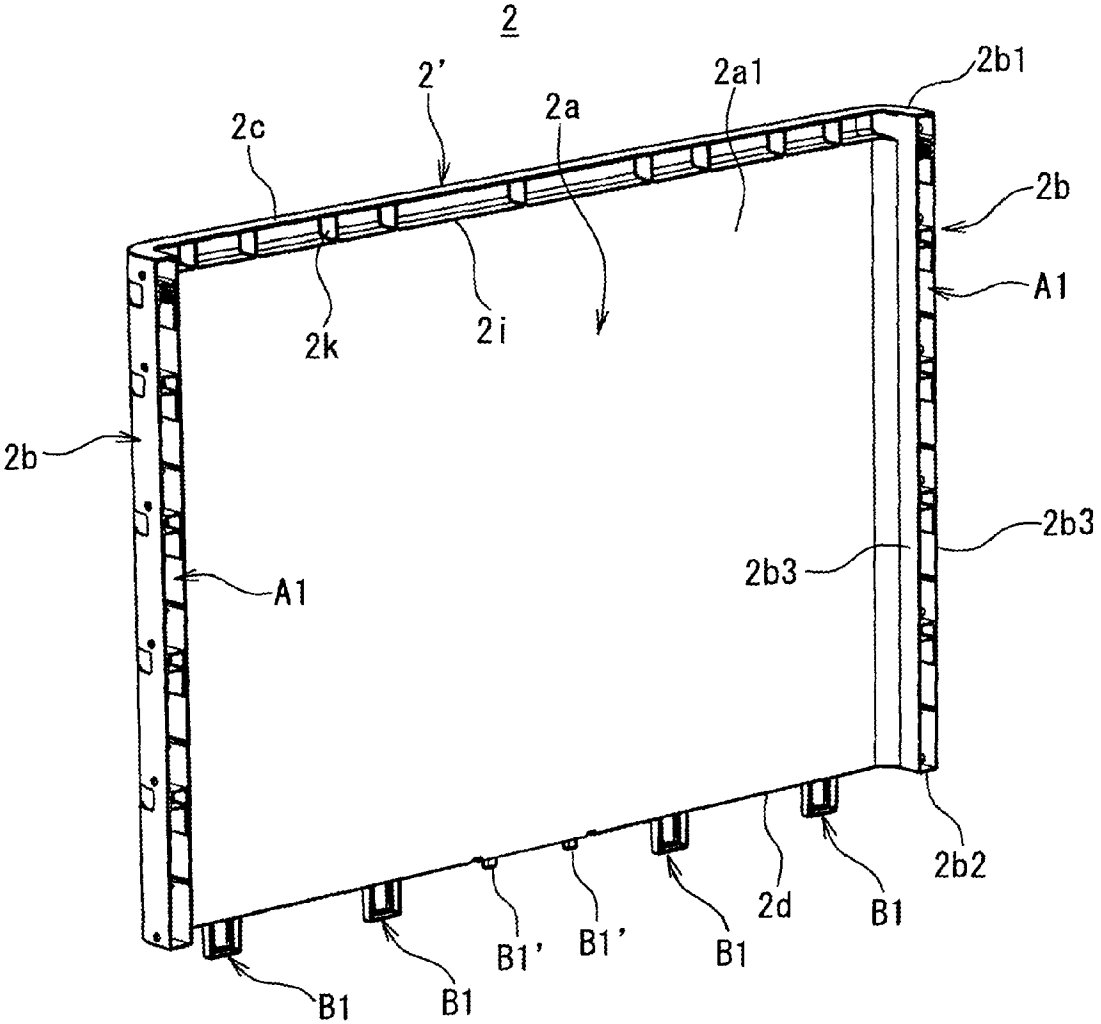
FIG. 4 is a perspective view of a long wall member included in the container.
Figure 5:
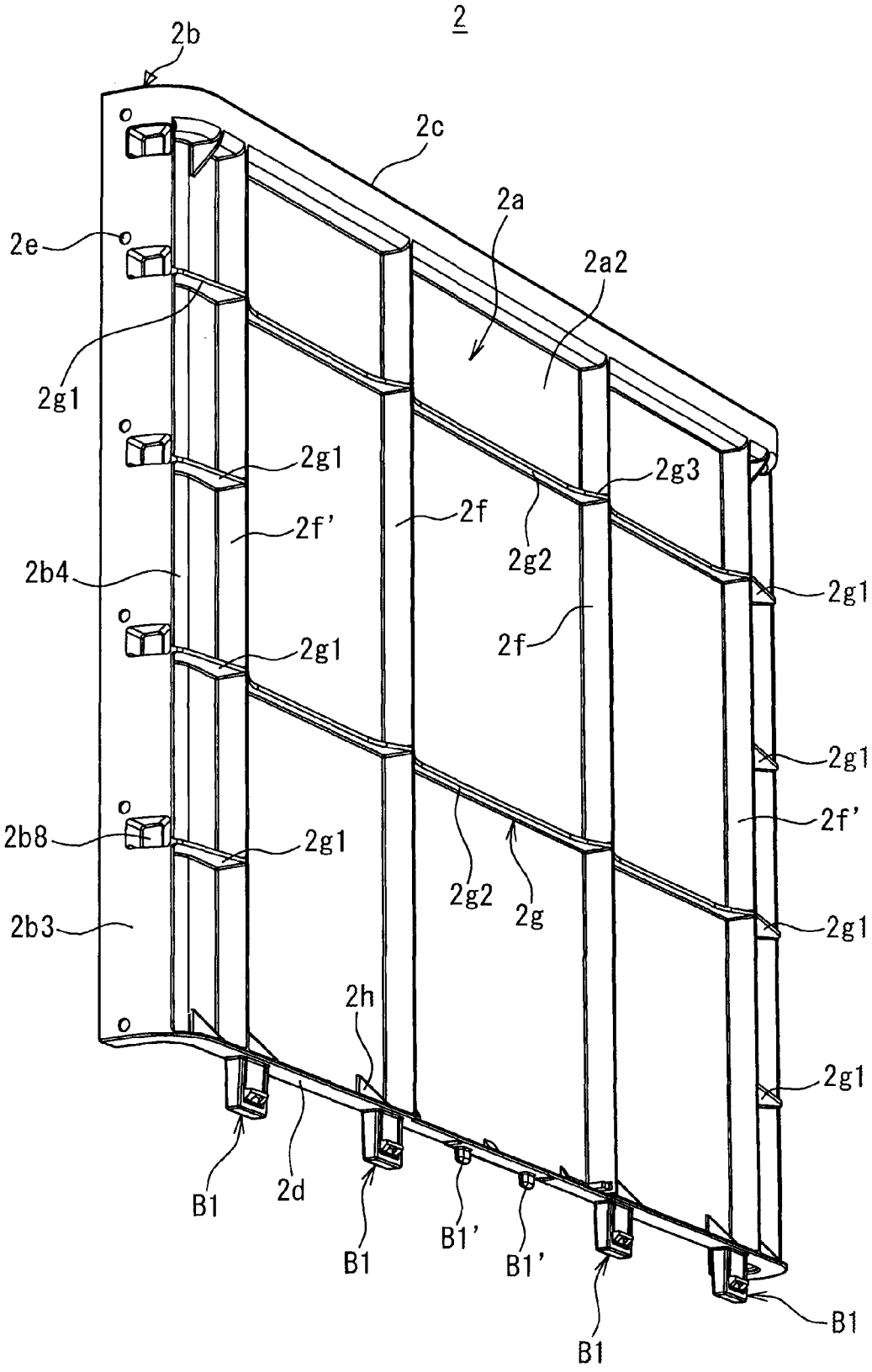
FIG. 5 is also a perspective view of the long wall member included in the container.
Figure 6:
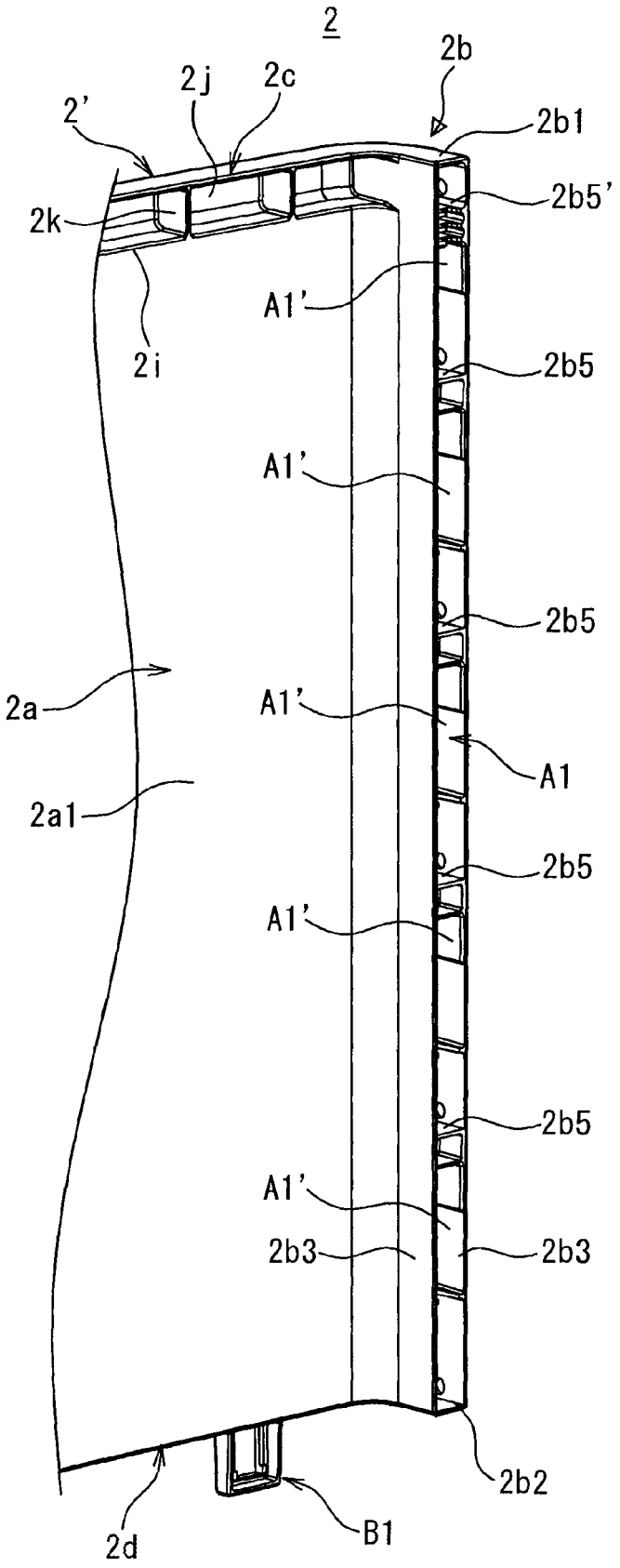
FIG. 6 is a partly enlarged perspective view of the long wall member shown in FIG. 4.
Figure 7:
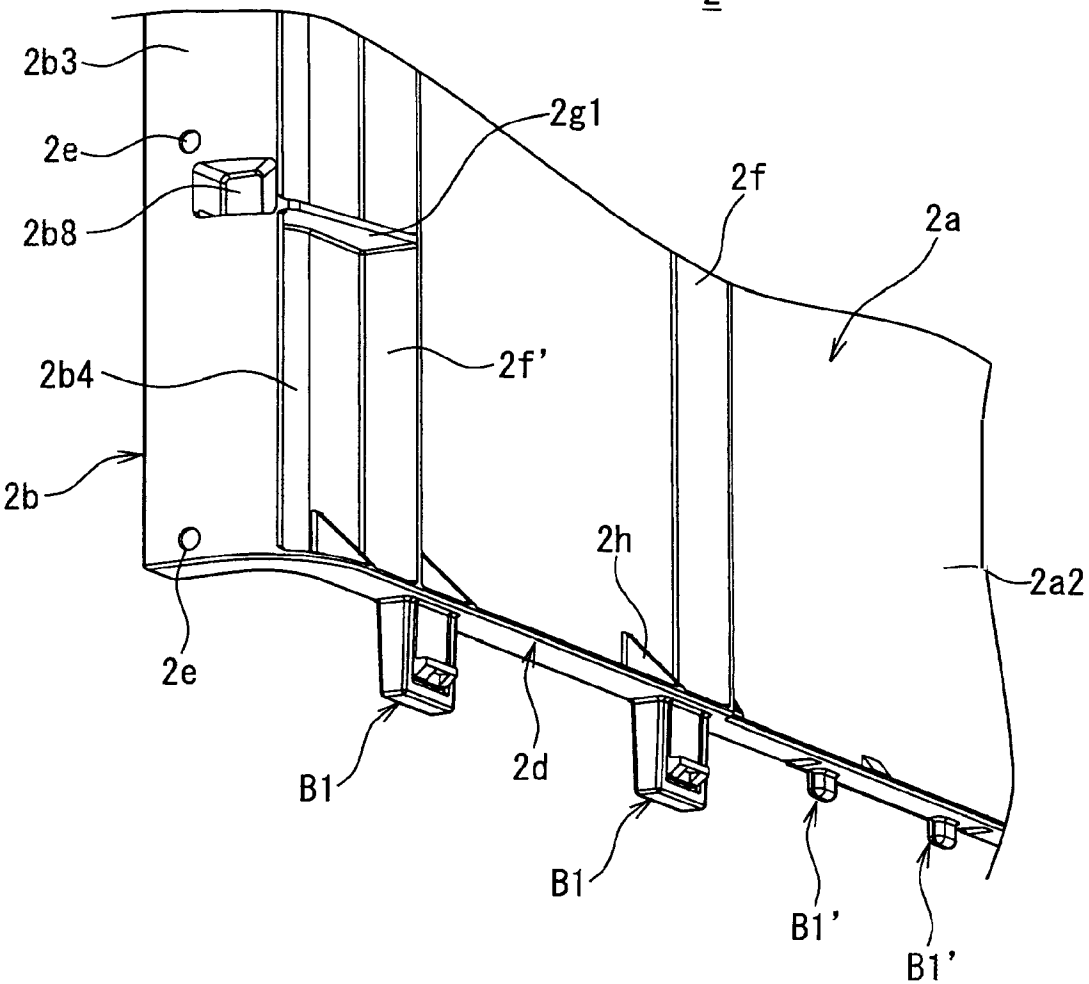
FIG. 7 is also a partly enlarged perspective view of the long wall member shown in FIG. 4.
Figure 8:
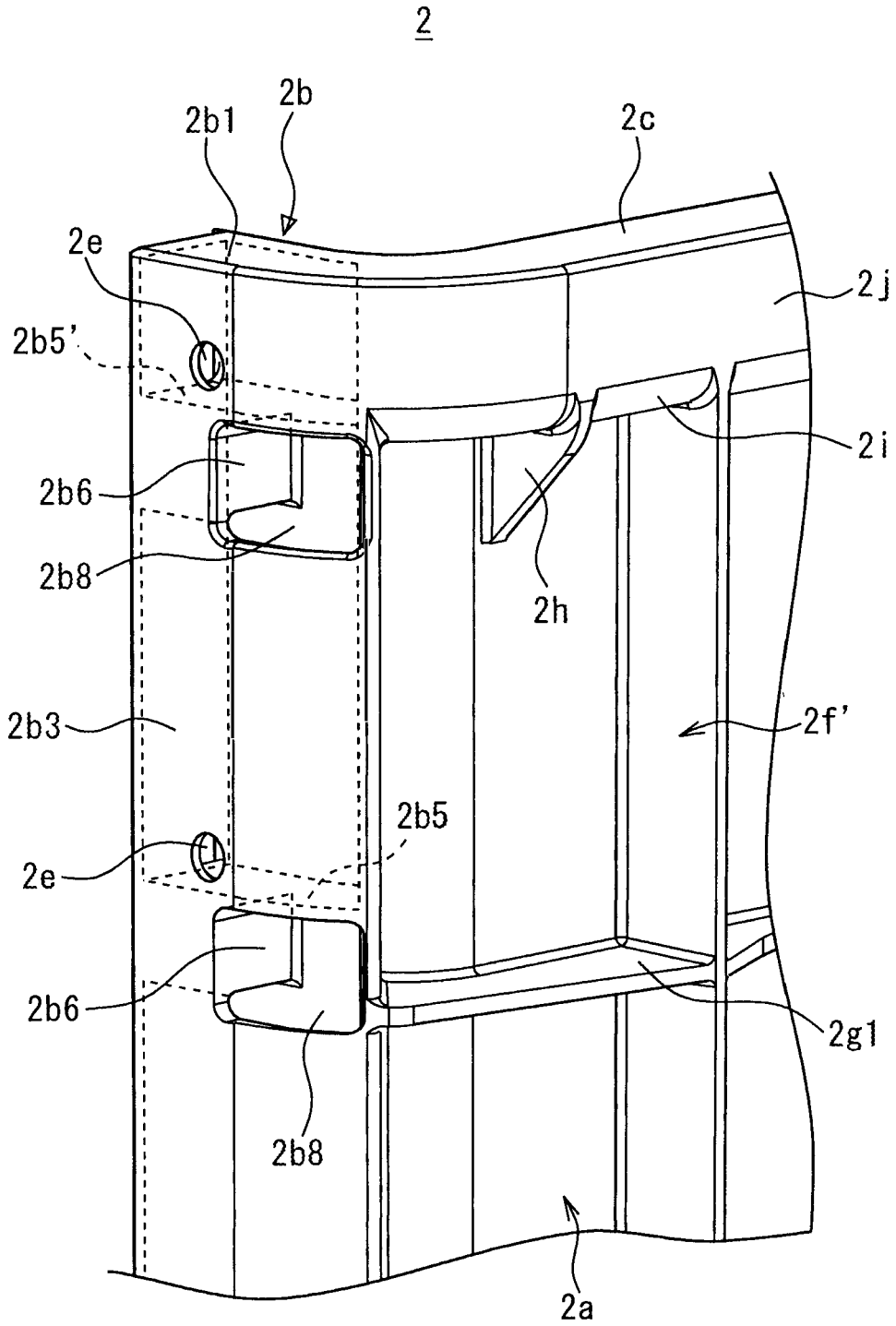
FIG. 8 is also a partly enlarged perspective view of the long wall member shown in FIG. 4.
Figure 9:
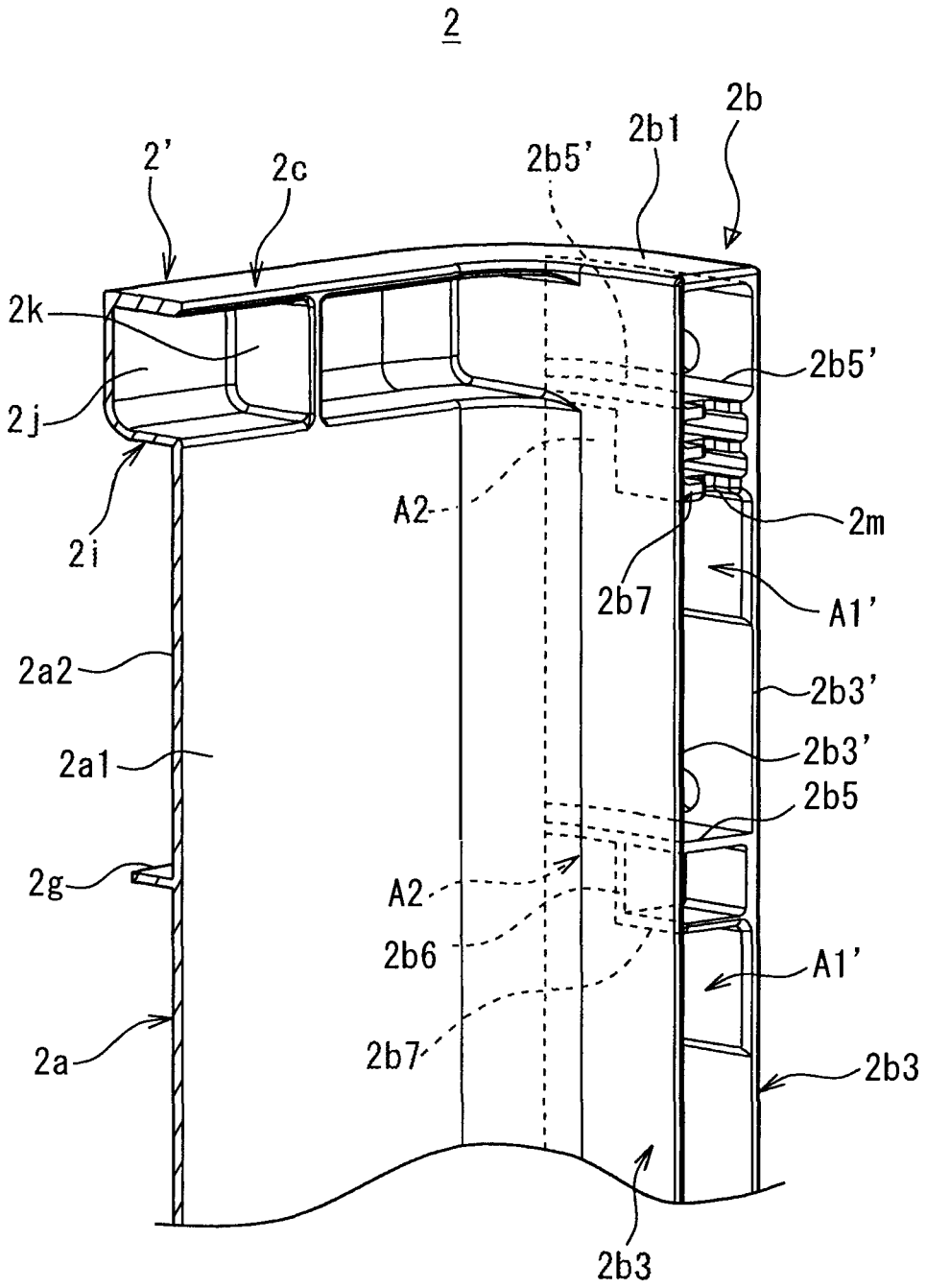
FIG. 9 is also a partly enlarged perspective view of the long wall member shown in FIG. 4.
Figure 10:
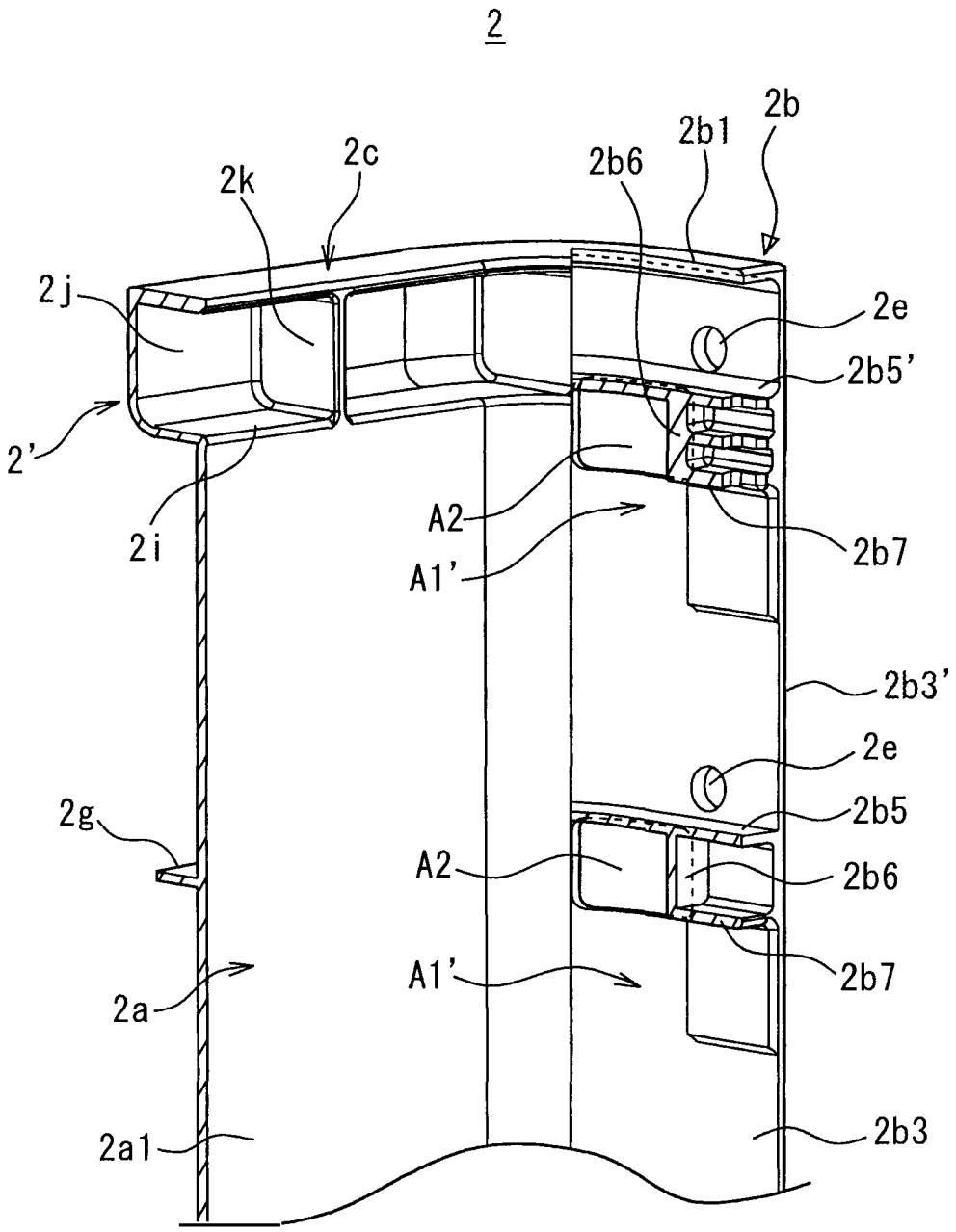
FIG. 10 is also a partly enlarged perspective view of the long wall member shown in FIG. 4, including a partial vertical cross-sectional view thereof.
Figure 11:
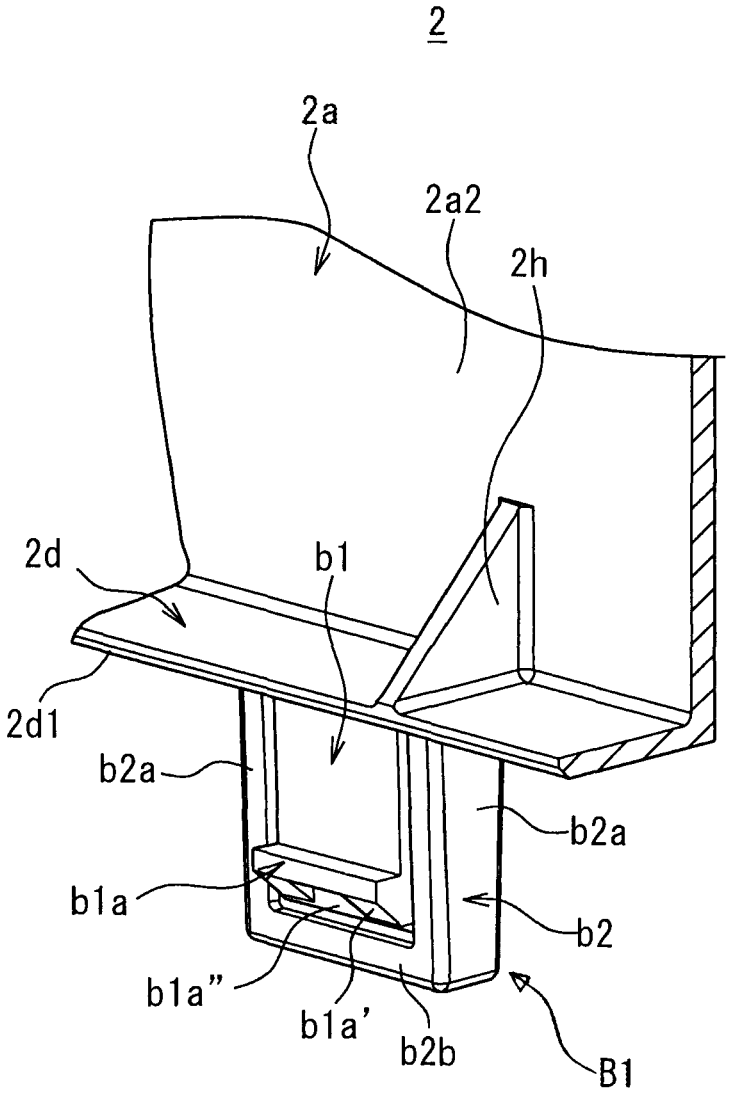
FIG. 11 is also a partly enlarged perspective view of the long wall member shown in FIG. 4.
Figure 12:
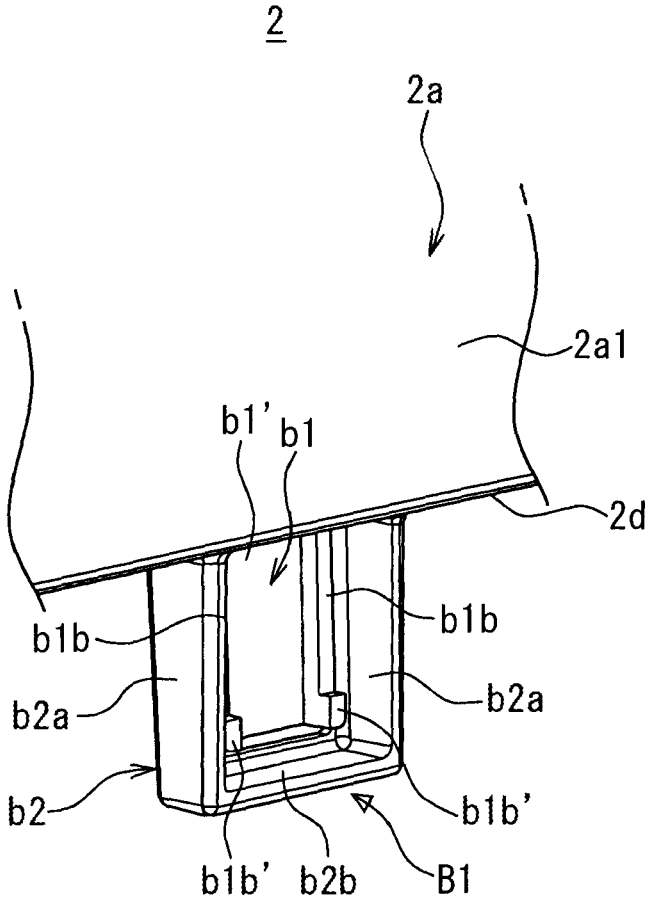
FIG. 12 is also a partly enlarged perspective view of the long wall member shown in FIG. 4.
Figure 13:
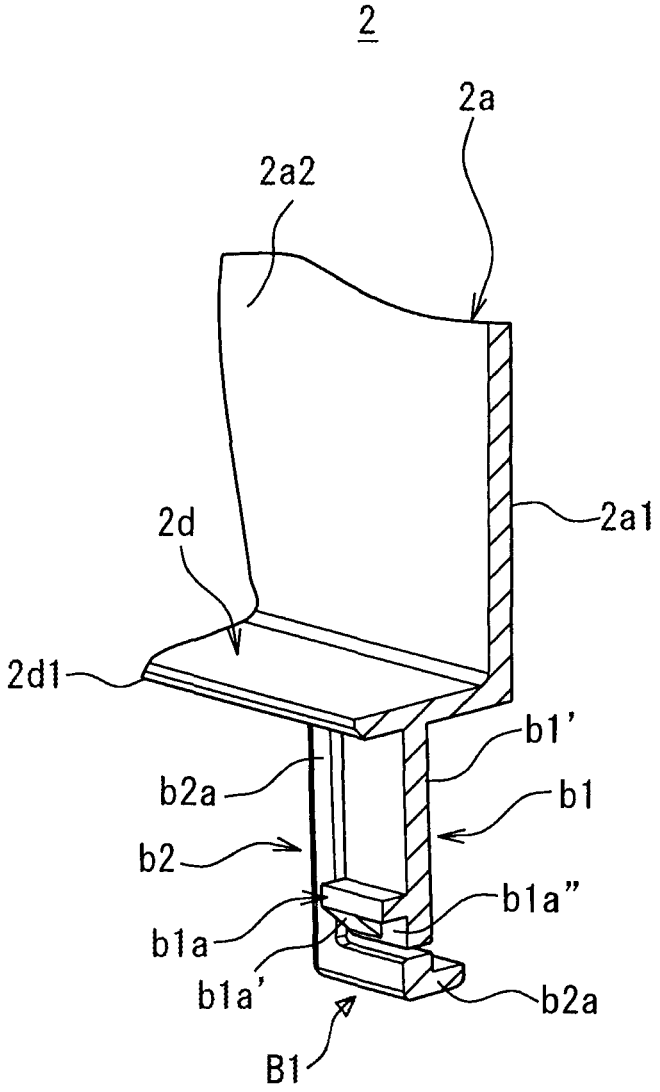
FIG. 13 is also a partly enlarged perspective view of the long wall member shown in FIG. 4, including a partial vertical cross-sectional view thereof.
Figure 14:
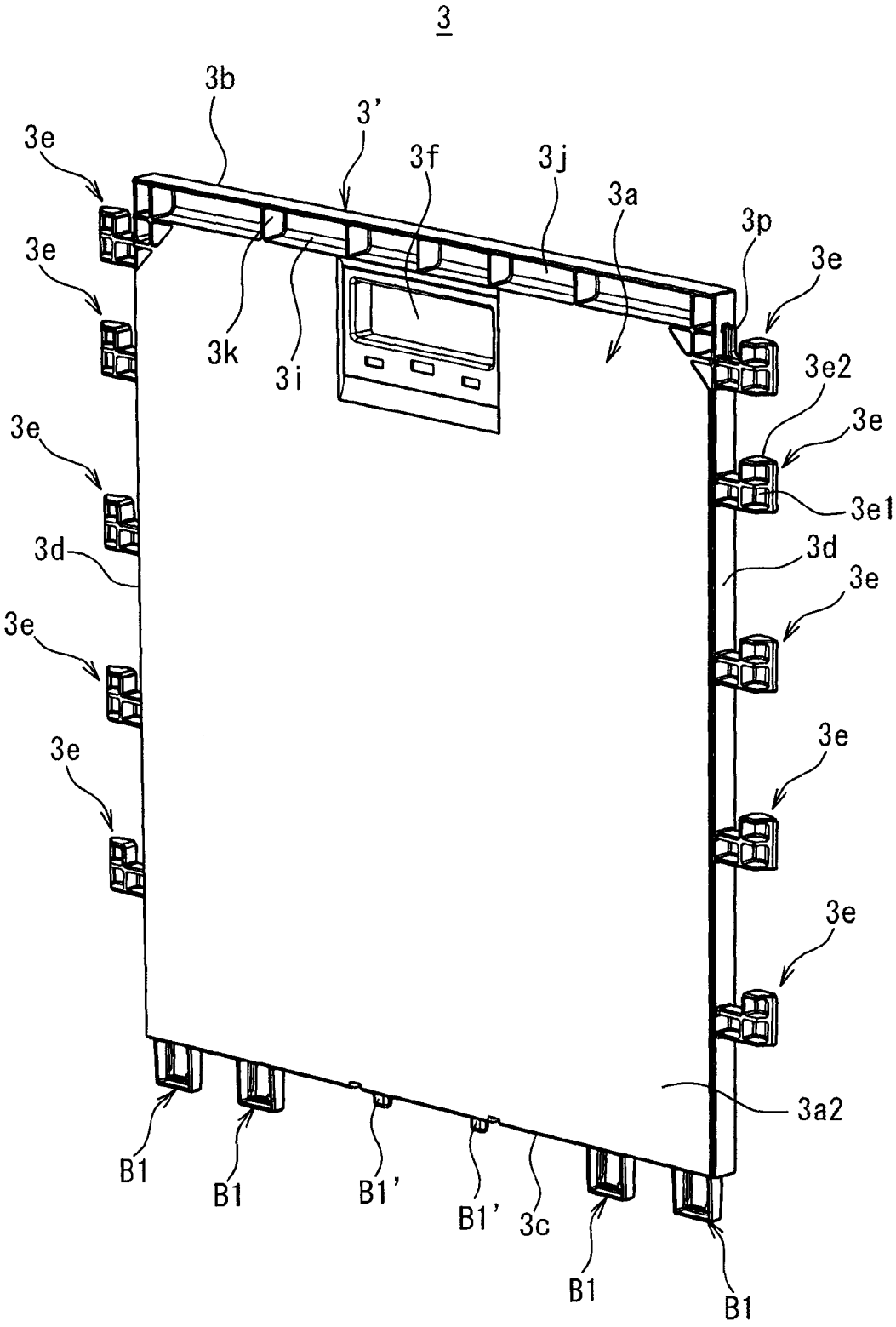
FIG. 14 is a perspective view of a short wall member included in the container according to the present invention.
Figure 15:
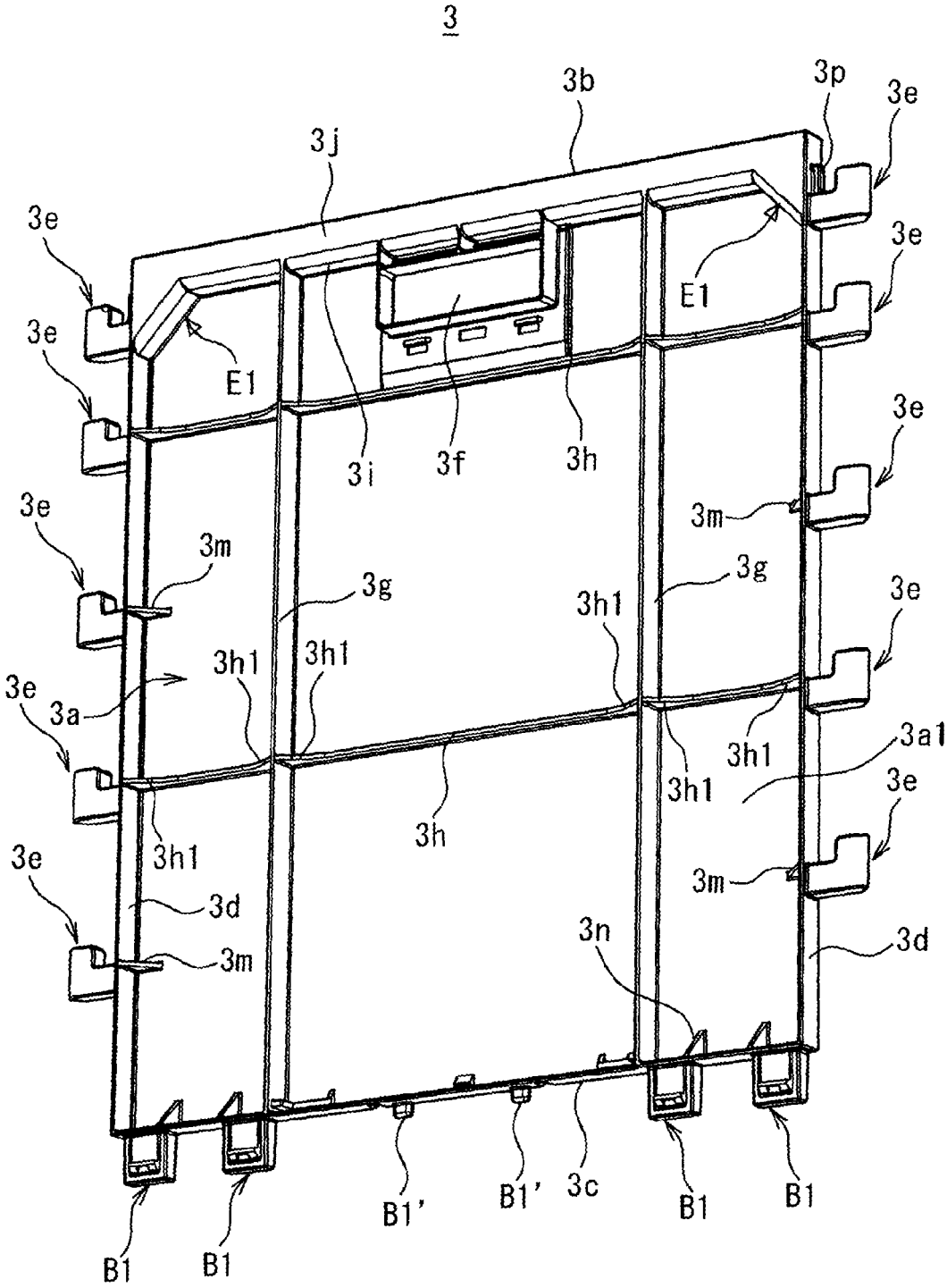
FIG. 15 is also a perspective view of the short wall member included in container according to the present invention.
Figure 16:
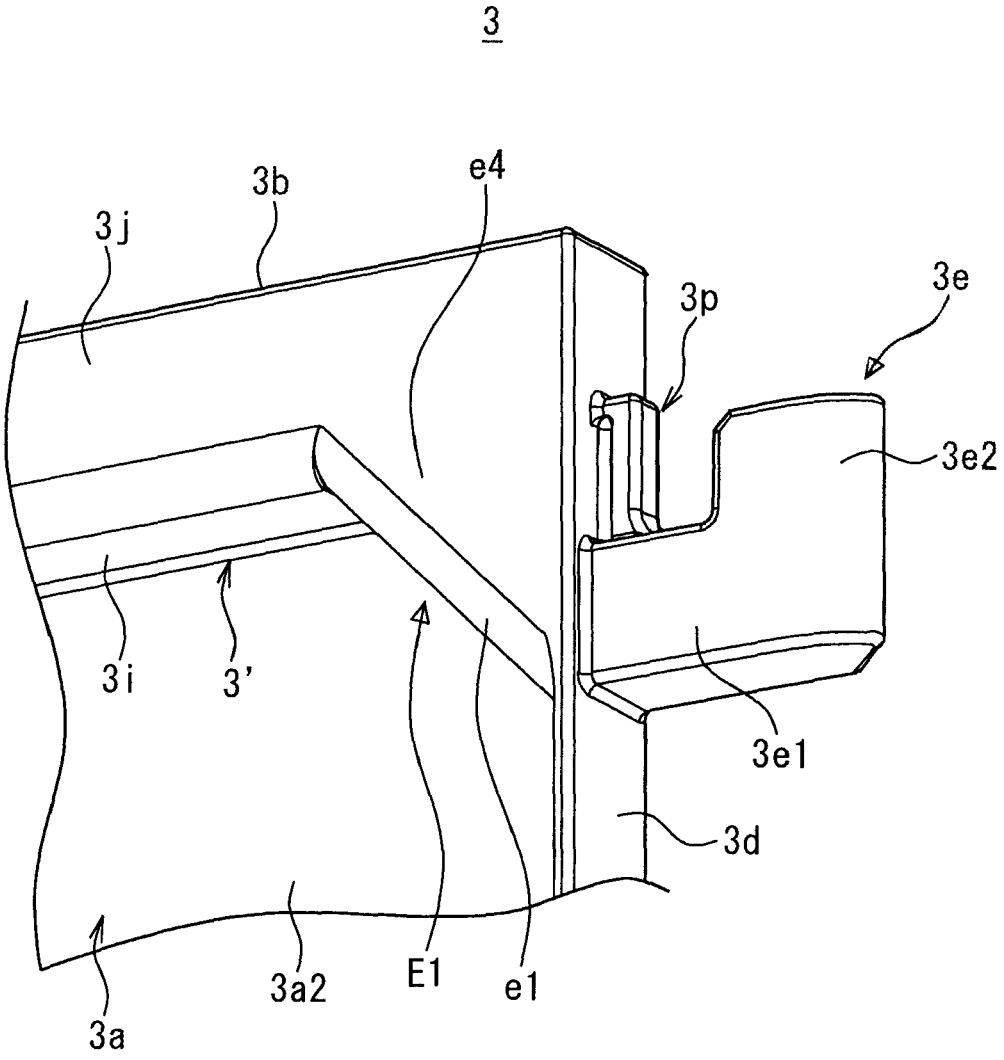
FIG. 16 is a partly enlarged perspective view of the short wall member included in the container according to the present invention.
Figure 17:
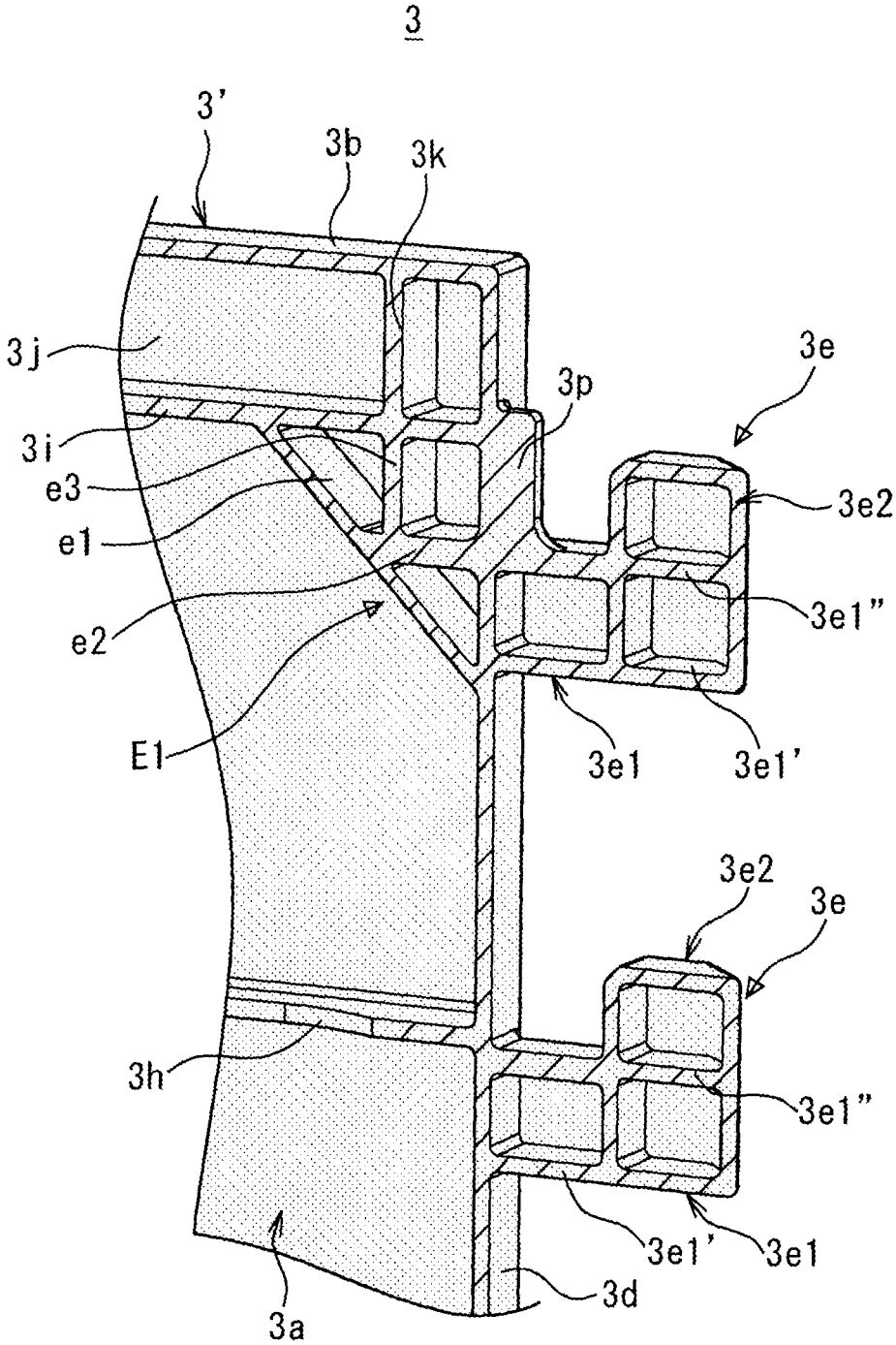
FIG. 17 is a partly enlarged perspective view of the short wall member included in the container according to the present invention, including a partial vertical cross-sectional view thereof.
Figure 18:
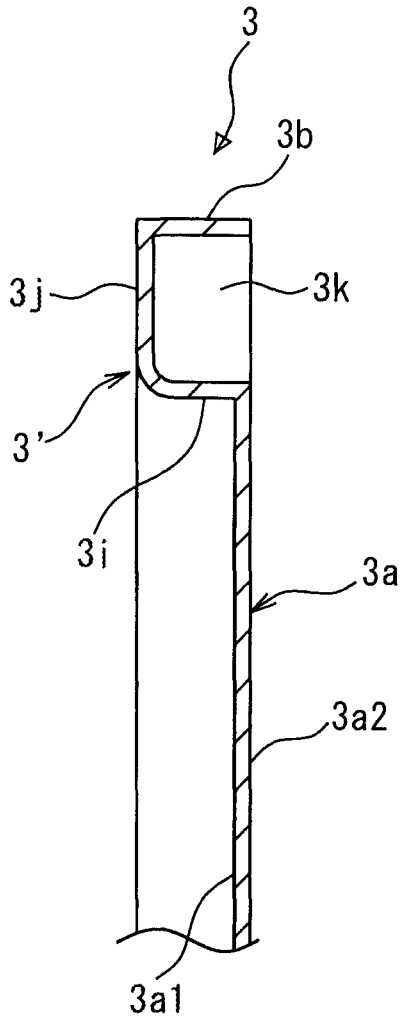
FIG. 18 is a vertical partial cross-sectional view of the short wall member included in the container according to the present invention.

Now, the bottom member 1 will be described with reference to FIG. 2 and FIG. 3.

The bottom member 1 includes a bottom plate portion 1*a* with a substantially rectangular planar shape and a peripheral wall portion 1*b* erected integrally with the bottom plate portion 1*a*. The peripheral wall portion 1*b* includes long side peripheral walls 1*b*1 erected on opposite long side portions of the bottom plate portion 1*a* and short side peripheral walls 1*b*2 erected on opposite short side portions of the bottom plate portion 1*a*. In the present embodiment, the bottom plate portion 1*a* includes a flat plate 1*a*1 forming the bottom plate portion 1*a* and recessed portions 1*a*2 each having a square planar shape and formed by recessing the flat plate 1*a*1 downward.

The peripheral wall portion 1*b* includes a peripheral upper-end horizontal flange 1*c* formed at and extended outward from the upper end. Furthermore, the peripheral wall portion 1*b* includes a peripheral lower-end horizontal flange 1*d* formed close to a lower end thereof and extended outward. Additionally, four corners 1*c*1 of the peripheral upper-end horizontal flanges 1*c* are coupled to respective four corners 1*d*1 of the peripheral lower-end horizontal flange 1*d* by respective band plate-like corner vertical ribs 1*e*. Moreover, linear portions 1*c*2 of the peripheral upper-end horizontal flange 1*c* are coupled to respective linear portions 1*d*2 of the peripheral lower-end horizontal flange 1*d* by an appropriate number of plate-like vertical ribs 1*f*. In the present embodiment, each of the vertical ribs 1*f* is formed of an intermediate band-like portion 1*f*1, an upper triangular portion 1*f*2 formed in a corner between an upper end of the intermediate band-like portion 1*f*1 and a lower surface of the peripheral upper-end horizontal flange 1*c*, and a lower triangular portion 1*f*3 formed in a corner between an lower end of the intermediate band-like portion 1*f*1 and an upper surface of the peripheral lower-end horizontal flange 1*d*.

In the present embodiment, the vertical rib 1*f* is formed by extending one of opposite side plate portions 1*g*2 forming a fitting member 1*g* to the peripheral lower-end horizontal flange 1*d*. Furthermore, the vertical rib 1*f* is formed by extending one of the opposite side plate portions 1*g*2 forming the fitting member 1*g* to an inclined piece 1*i*2 forming a bottom corner reinforcing portion 1*i*. Alternatively, the vertical rib 1*f* may be formed so as to couple the peripheral upper-end horizontal flange 1*c* and the peripheral lower-end horizontal flange 1*d* together.

The fitting members 1*g* are formed on the linear portion 1*c*2 of the peripheral upper-end horizontal flange 1*c* at predetermined intervals. The fitting member 1*g* is formed of a fitting hole 1*g*1 drilled in the linear portion 1*c*2 of the peripheral upper-end horizontal flange 1*c*, opposite side plate portions 1*g*2 crossing a longitudinal direction of the linear portion 1*c*2 of the peripheral upper-end horizontal flange 1*c* at right angles and suspended from a back surface of the linear portion 1*c*2 of the peripheral upper-end horizontal flange 1*c*, a horizontal plate portion 1*g*3 connecting lower ends of the opposite side plate portions 1*g*2 together, and a partitioning plate portion 1*g*4 which closes a side opening formed by the side plate portions 1*g*2 and the horizontal plate portion 1*g*3 and which is arranged parallel to a flat part of the peripheral wall portion 1*b*, that is, the entire peripheral wall portion 1*b* except for four corners 1*d*1, and at a distance from the peripheral wall portion 1*b*. Furthermore, a locking through-slot 1*g*4' is formed in the partitioning plate portion 1*g*4.

The fitting member 1*g* is configured as described above and thus includes a fitting vertical slot H1 formed by the fitting hole 1*g*1 drilled in the linear portion 1*c*2 of the peripheral upper-end horizontal flange 1*c*, the opposite side plate portions 1*g*2, the horizontal plate portion 1*g*3, the partitioning plate portion 1*g*4, and the flat part of the peripheral wall portion 1*b* parallel to the partitioning plate portion 1*g*4. In the present embodiment, four fitting vertical slots H1 are formed in each of the opposite linear portions 1*c*2; a total of 16 fitting vertical slots H1 are formed. Furthermore, each of the linear portions 1*c*2 of the peripheral upper-end horizontal flange 1*c* includes sub-fitting vertical slots h1 formed in a central part thereof. In the present embodiment, two sub fitting vertical slots h1 are formed in each of the opposite linear portions 1*c*2; a total of eight sub fitting vertical slots h1 are formed.

For the band-like corner vertical rib 1*e*, which couples the corner 1*c*1 of the peripheral upper-end horizontal flange 1*c* formed on the bottom member 1 described above to the corner 1*d*1 of the peripheral lower-end horizontal flange 1*d*, lower parts of opposite side surfaces of the band-like corner vertical rib 1*e* connect to horizontal pieces 1*i*1 which are perpendicular to the band plate-like corner vertical rib 1*e* and parallel to the peripheral lower-end horizontal flange 1*d*. A tip of each of the horizontal pieces 1*i*1 is coupled, by an inclined piece 1*i*2, to a tip of the peripheral lower-end horizontal flange 1*d* positioned at the corner 1*d*1.

As described above, the bottom corner reinforcing portion 1*i* formed by the horizontal piece 1*i*1 and the inclined piece 1*i*2 is formed at each corner of the bottom member 1. Thus, the bottom member 1 can be increased in strength and rigidity and prevented from undergoing torsional deformation. Furthermore, the container C1 assembled into a box shape can further be increased in strength and rigidity, and the bottom member 1 can further be prevented from undergoing torsional deformation. Reinforcing triangular ribs 1*j* may be formed at each corner formed by the peripheral upper-end horizontal flange 1*c* and the peripheral wall portion 1*b* and each corner formed by the peripheral lower-end horizontal flange 1*d* and the peripheral wall portion 1*b*.

Now, the long wall member 2 will be described with reference to FIG. 4 to FIG. 13.

The long wall member 2 includes a flat plate portion 2*a*, and vertically elongate coupling portions 2*b* extended from opposite vertical sides of the flat plate portion 2*a* and substantially perpendicularly to an inner surface (the surface positioned inside the container C1 when the container C1 is assembled into a box shape) 2*a*1 of the flat plate portion 2*a* and over the overall height of the opposite vertical sides of the flat plate portion 2*a*. Furthermore, an upper-end horizontal flange 2*c* is formed at the upper end of the flat plate portion 2*a* and the vertically elongate coupling portions 2*b* so as to extend outward perpendicularly to an outer surface (the surface positioned outside the container C1 when the container C1 is assembled into a box shape) 2*a*2 of the flat plate portion 2*a*. Moreover, a lower-end horizontal flange 2*d* is formed at the lower end of the flat plate portion 2*a* and the vertically elongate coupling portions 2*b* so as to extend outward perpendicularly to the outer surface 2*a*2 of the flat plate portion 2*a*.

The vertically elongate coupling portion 2*b* includes a vertically elongate space portion A1 formed by an upper-end horizontal plate portion 2*b*1 formed by extending the upper-end horizontal flange 2*c*, a lower-end horizontal plate portion 2*b*2 lying opposite the upper-end horizontal plate portion 2*b*1 and formed by extending the lower-end horizontal flange 2*d*, opposite vertical side plate portions 2*b*3, and an inside wall 2*b*4. The vertically elongate space portion A1 is extended from tips 2*b*3' of the opposite vertical side plates 2*b*3 to the inside wall 2*b*4. An appropriate number of horizontal partitioning plate portions 2*b*5 are formed to connect to the opposite vertical side plates 2*b*3 and the inside wall 2*b*4. The formation of these horizontal partitioning plate portions 2*b*5 allows the vertically elongate space portion A1 to be partitioned into a plurality of subs space portion A1'. For convenience of description, the horizontal partitioning plate portion 2*b*5 lying opposite the upper-end horizontal plate portion 2*b*1 is referred to as an upper-end horizontal partitioning plate portion and denoted by reference numeral 2*b*5'. The horizontal partitioning plate portion 2*b*5 lying opposite the lower-end horizontal plate portion 2*b*2 is referred to as a lower-end horizontal partitioning plate portion and denoted by reference numeral 2*b*5". In the present embodiment, the vertically elongate space portion A1 is partitioned into five subs space portions A1'.

The upper-end horizontal partitioning plate portion 2*b*5' includes a vertical piece 2*b*6 suspended from a lower surface of a central part thereof and connected to the opposite vertical side plate portions 2*b*3. The vertical short piece 2*b*6 includes a horizontal piece 2*b*7 formed at a lower end thereof and connected to the opposite vertical side plate portions 2*b*3 and extended to the tips 2*b*3' of the opposite vertical side plate portions 2*b*3. The formation of the vertical piece 2*b*6 and the horizontal piece 2*b*7 allows a fitting space A2 opening downward to be formed under the lower-end horizontal partitioning plate portion 2*b*5' by the opposite vertical side plate potions 2*b*3, the inside wall 2*b*4, the upper-end horizontal partitioning portion 2*b*5', and the vertical piece 2*b*6.

Similarly, the above-described vertical piece 2*b*6 is suspended from a lower surface of a central part of each of the horizontal partitioning plate portions 2*b*5 positioned between the upper-end horizontal partitioning plate portion 2*b*5' and the lower-end horizontal partitioning plate portion 2*b*5", and the above-described horizontal piece 2*b*7 is formed at the lower end of the vertical short piece 2*b*6. The formation of the vertical piece 2*b*6 and the horizontal piece 2*b*7 allows a similar fitting space A2 to be formed under the horizontal partitioning plate portion 2*b*5.

As described above, the vertically elongate coupling portion 2*b* is formed by the upper-end horizontal plate portion 2*b*1, the lower-end horizontal plate portion 2*b*2, the opposite vertical side plate portions 2*b*3, and the inside wall 2*b*4. Thus, the vertically elongate coupling portion 2*b* can be increased in strength and rigidity and prevented from undergoing torsional deformation. Furthermore, the container C1 assembled into a box shape can be increased in strength and rigidity and prevented from undergoing torsional deformation. Additionally, when the opposite vertical side plate portions 2*b*3 included in the vertically elongate coupling portion 2*b* are coupled together by the horizontal partitioning plate portions 2*b*5, the vertical pieces 2*b*6, and the horizontal pieces 2*b*7, the vertically elongate coupling portion 2*b* can further be increased in strength and rigidity and more reliably prevented from undergoing torsional deformation. Furthermore, the container C1 assembled into a box shaped can further be increased in strength and rigidity and more reliably prevented from undergoing torsional deformation. Moreover, one of the opposite vertical side plate portions 2*b*3 which is positioned outside avoids having a rib structure and thus serves to prevent the vertically elongate coupling portion 2*b* from being damaged.

Furthermore, a fitting block member B1 is suspended from a back surface of the lower-end horizontal flange 2*d* of the long wall member 2; the fitting block member B1 is fitted into the corresponding fitting vertical slot H1 in the fitting member 1*g* formed on the linear portion 1*c*2 of the peripheral upper-end horizontal flange 1*c* included in the above-described bottom member 1.

A plurality of the fitting block members B1 are formed on the back surface of the lower-end horizontal flange 2*d* along the longitudinal direction of the lower-end horizontal flange 2*d*. A plate-like elastic tongue portion b1 included in the fitting block member B1 is suspended from the back surface of the lower-end horizontal flange 2*d* along the longitudinal direction of the lower-end horizontal flange 2*d*. The elastic tongue portion b1 includes a horizontal locking projecting portion bia formed at a lower end thereof and extended toward a tip 2*d*1 of the lower-end horizontal flange 2*d*. A lower surface of the locking projecting portion b1*a* is formed into an inclined surface b1*a*' inclined downward from a tip of the locking projecting portion b1*a* toward the elastic tongue portion b1. Furthermore, the locking projecting portion b1*a* is configured to be fitted and locked in the corresponding locking though-hole 1*g*4' drilled in the partitioning plate portion 1*g*4 of the fitting member 1*g* formed in the bottom member 1 when the container C1 is assembled into a box shape. Moreover, the locking projecting portion b1*a* includes a recessed portion b1*a*" formed in a central part thereof and opening downward and toward the tip 2*d*1 of the lower-end horizontal flange 2*d*. Additionally, the elastic tongue piece b1 include vertical thick portions b1*b* formed on an inner surface (the surface positioned inside the container C1 when the container C1 is assembled) b1' thereof along respective opposite vertical side portions thereof. Each of the vertical thick portions b1*b* includes an elastic deformation suppressing projection b1*b*' projected from a lower end thereof to suppress elastic deformation of the elastic tongue piece b1. The vertical thick portions b1*b* may be omitted, and the elastic deformation suppressing projections b1*b*' may be projected directly from the inner surface b1' of the elastic tongue piece b1.

The above-described elastic piece b1 is configured to cross the longitudinal direction of the lower-end horizontal flange 2*d* at right angles and such that side portions and a lower end thereof are protected by an elastic tongue piece protecting member b2 including opposite vertical side plate portions b2*a* suspended from the back surface of the lower-end horizontal flange 2*d* and a lower-end horizontal plate portion b2*b* coupling lower ends of the vertical side plate portions b2*a* together. Furthermore, the locking projecting portion b1*a* formed at the lower end of the above-described elastic tongue piece b1 is configured to project outward beyond the elastic tongue piece protecting member b2.

Furthermore, viewing through-slots 2*b*8 each formed so as to overlap the fitting space A2 are drilled in one of the opposite vertical side plate portions 2*b*3 forming the vertically elongate coupling portion 2*b* which is positioned outside (the side positioned outside the container C1 when the container C1 is assembled into a box shape).

Drain through-slots 2*e* are drilled in one of the opposite vertical side plate portions 2*b*3 forming the vertically elongate coupling portion 2*b* which is positioned outside (the side positioned outside the container C1 when the container C1 is assembled into a box shape). An appropriate number of vertical ribs 2*f* are formed on the outer surface 2*a*2 of the long wall member 2. An appropriate number of horizontal ribs 2*g* are formed on the outer surface 2*a*2 of the long wall member 2.

For portions (hereinafter referred to as high portions and denoted by reference numeral 2*g*1) of the horizontal ribs 2*g* which are positioned between each of the vertically elongate coupling portions 2*b* and the corresponding one of the vertical ribs (hereinafter referred to as opposite-end vertical ribs and denoted by reference numeral 2*f*') positioned at the widthwise opposite ends of the log wall member 2, the height (from the outer surface 2*a*2 of the flat plate portion 2*a* to a tip of each of the horizontal ribs 2*g*) is set substantially the same as the that of the opposite-end vertical ribs 2*f*' (the height from the outer surface 2*a*2 of the flat plate portion 2*a* to a tip of each of the opposite-end vertical ribs 2*f*'). This configuration enables the vertically elongate coupling portions 2*b* to be increased in strength and rigidity.

Furthermore, the height of portions 2*g*2 of the horizontal ribs 2*g* positioned between each of the opposite-end vertical ribs 2*f*' and the vertical rib 2*f* lying opposite the opposite-end vertical rib 2*f*' and between the opposite vertical ribs 2*f* is set smaller than that of the high portions 2*g*1 (the height from the outer surface 2*a*2 of the flat plate portion 2*a* to the tip of each of the horizontal ribs 2*g*). Each of the portions 2*g*2 of the horizontal ribs 2*g* formed to be lower than the high portion 2*g*1 is coupled, by a triangular portion 2*g*3, to the opposite-end vertical rib 2*f*' and the vertical rib 2*f*. This configuration enables the long wall member 2 to be increased in strength and rigidity and to be reduced in weight.

Furthermore, as described above, one of the vertical side plate portions 2*b*3 forming the vertically elongate coupling portion 2*b* which is positioned outside includes the viewing through-slots 2*b*8 drilled therein and each overlapping the fitting space A2 at an upper part of the viewing through-slot 2*b*8. Each of the high portions 2*g*1 of the horizontal rib 2*g* is arranged in abutting contact with a part of the vertically elongate coupling portion 2*b* which is positioned close to the corresponding viewing through-slot 2*b*8. This configuration allows the parts of the vertically elongate coupling portion 2*b* positioned close to the respective viewing through-slots 2*b*8 and thus the long wall member 2 to be increased in strength and rigidity.

Moreover, the sub fitting block members B1' fitted into the respective sub fitting vertical slots h1 formed in the peripheral upper-end horizontal flange 1*c* of the above-described bottom member 1 are suspended from the back surface of the lower-end horizontal flange 2*d*. When the sub fitting block members B1' fitted into the respective sub fitting vertical slots h1 formed in the peripheral upper-end horizontal flange 1*c* of the above-described bottom member 1 are thus suspended from the back surface of the lower-end horizontal flange 2*d*, the long wall member 2 can be prevented from being tiled when erected. Triangular reinforcing ribs 2*h* may be formed in corners formed by the outer surface 2*a*2 of the flat plate portion 2*a* and the lower-end horizontal flange 2*d*.

Moreover, an outer tip of each upper horizontal flange 2*i* formed under and close to the upper-end horizontal flange 2*c* of the long wall member 2 is coupled to an outer tip of the upper-end horizontal flange 2*c* by a vertical coupling band-like plate 2*j* lying parallel to the flat plate portion 2*a*. Thus, the long wall member 2 includes an upper reinforcing portion 2' located in an upper part thereof and formed of the upper-end horizontal flange 2*c*, the upper horizontal flange 2*i*, and the vertical coupling band-like plate 2*j* coupling the outer tip of the upper-end horizontal flange 2*c* to the outer tip of the upper horizontal flange 2*i*, the upper reinforcing portion 2' having a generally C-shaped cross section (a vertical cross section perpendicular to the longitudinal direction of the upper-end horizontal flange 2*c* of the long wall member 2). As a result, the long wall member 2 can be increased in strength and rigidity and prevented from undergoing torsional deformation. Furthermore, the container C1 formed into a box shape can be increased in strength and rigidity and prevented from undergoing torsional deformation. Vertical reinforcing coupling ribs coupling the upper-end horizontal flange 2*c* to the upper horizontal flange 2*i* are denoted by 2*k*.

Now, the short wall member 3 will be described with reference to FIG. 14 to FIG. 18.

The short wall member 3 includes a flat plate portion 3*a*, an upper-end horizontal flange 3*b* extended outward from an upper end of the flat plate portion 3*a* and perpendicularly to an outer surface (the surface positioned outside the container C1 when the container C1 is assembled into a box shape) 3*a*1, and a lower-end horizontal flange 3*c* extended outward perpendicularly to the outer surface 3*a*1. The short wall member 3 further includes opposite endwise vertical side plate portions 3*d* coupling an end of the upper-end horizontal flange 3*b* to the lower-end horizontal flange 3*c*.

Fitting block members 3*e* are formed on the opposite endwise vertical side plate portions 3*d* and each include a horizontal portion 3*e*1 perpendicular to the endwise vertical side plate portion 3*d* and a vertical portion 3*e*2 extended upward from and perpendicularly to a tip of the horizontal portion 3*e*1. The fitting block members 3*e* are the same, in number, as the fitting spaces A2 formed in the vertically elongate coupling portion 2*b* of the long wall member 2. In the present embodiment, as described above, five fitting spaces A2 are formed in the vertically elongate coupling portion 2*b* of the long wall member 2, and thus five fitting block members 3*e* are formed. When the long wall member 2 and the short wall member 3 are coupled together, the vertical portion 3*e*2 of each of the fitting block member 3*e* is fitted into the corresponding fitting space A2. Furthermore, the short wall member 3 includes fitting blocks B1 suspended from a back surface of the lower-end horizontal flange 3*c* and which are similar to the fitting blocks B1 suspended from the back surface of the lower-end horizontal flange 2*d* of the above-described long wall member 2.

Handheld through-slots 3*f* are drilled in an upper part of the flat plate portion 3*a* of the short wall member 3. An appropriate number of vertical ribs are denoted by 3*g* and formed on the outer surface 3*a*1 of the short wall member 3. An appropriate number of horizontal ribs 3*h* are formed on the outer surface 3*a*1 of the short wall member 3. Furthermore, the height of each of the horizontal ribs 3*h* (the height from the outer surface 3*a*1 of the flat plate portion 3*a* to a tip of the horizontal rib 3*h*) is mostly set lower than that of each of the vertical ribs 3*g*. Portions of the horizontal ribs 3*h* positioned between each of the endwise vertical side plate portions 3*d* and the vertical rib 3*g* lying opposite the endwise vertical side plate portion 3*d* and between the opposite vertical ribs 3*g* are coupled to the endwise vertical side plate portion 3*d* and the vertical rib 3*g* via triangular portions 3*h*1 each with a generally triangular planar shape. This configuration enables the short wall member 3 to be increased in strength and rigidity and to be reduced in weight.

Furthermore, the short wall member 3 includes upper horizontal flanges 3*i* formed under and close to the upper-end horizontal flange 3*b*. An outer tip of each of the upper horizontal flanges 3*i* is coupled to the upper horizontal flange 3*i* by a vertical coupling band-like plate 3*j* lying parallel to the flat plate portion 3*a*. Thus, the short wall member 3 includes an upper reinforcing portion 3' located in an upper part thereof and formed of the upper-end horizontal flange 3*b*, the upper horizontal flange 3*i*, and the vertical coupling band-like plate 3*j*, the upper reinforcing portion 2' having a generally C-shaped cross section (a vertical cross section perpendicular to the longitudinal direction of the upper horizontal flange 3*b* of the short wall member 3). The formation of the above-described upper reinforcing portion 3' enables the short wall member 3 to be increased in strength and rigidity and prevented from undergoing torsional deformation. Furthermore, the container C1 formed into a box shape can be increased in strength and rigidity and prevented from undergoing torsional deformation. An inner surface (the surface positioned inside the container when the container C1 is assembled) of the flat plate portion 3*a* is denoted by 3*a*2.

Moreover, upper corner reinforcing members E1 are each formed in a corner formed by the upper horizontal flange 3*i* and the endwise vertical side plate portion 3*d*. The upper corner reinforcing member E1 includes an inclined coupling rib e1 formed thereon to couple the vicinity of an end of the upper horizontal flange 3*i* to the vicinity of an upper end of the endwise vertical side plate portion 3*d*. A lower end of the inclined coupling rib e1 is positioned close to that part of a lower horizontal rib 3*e*1' of the horizontal portion 3*e*1 included in the fitting block member 3*e* which part is closer to the endwise vertical side plate portion 3*d*. The above-described formation of the upper corner reinforcing member E1 enables the short wall member 3 and thus the container C1 formed into a box shape to be increased in strength and rigidity. Additionally, the container C1 can be prevented from undergoing torsional deformation.

The inclined coupling rib e1 included in the upper corner reinforcing member E1 includes a horizontal rib e2 formed in the middle thereof and connected, via the endwise vertical side plate portion 3*d*, to the upper horizontal rib 3*e*1" of the horizontal portion 3*e*1 included in the fitting block member 3*e*. Furthermore, the upper corner reinforcing member E1 includes a vertical rib e3 formed therein and connected via the upper horizontal flange 3*i* to a vertical reinforcing coupling rib 3*k* coupling the upper-end horizontal flange 3*b* to the upper horizontal flange 3*i*. Moreover, the upper corner reinforcing member E1 includes a triangular corner outer-wall plate portion e4 formed parallel to the flat plate portion 3*a* and flush with the vertical coupling band-like plate 3*j*.

As described above, the upper corner reinforcing member E1 is formed in the corner formed by the upper horizontal flange 3*i* and the endwise vertical side plate portion 3*d*. Thus, the short wall member 3 and thus the container C1 assembled into a box shape can be increased in strength and rigidity. Moreover, the container C1 can be prevented from undergoing torsional deformation.

Furthermore, as described above, the upper corner reinforcing member E1 includes the inclined coupling rib e1 coupling the vicinity of the end of the upper horizontal flange 3*i* to the vicinity of the upper end of the endwise vertical side plate portion 3*d*. Thus, the short wall member 3 and thus the container C1 assembled into a box shape can be increased in strength and rigidity. Moreover, the container C1 can be prevented from undergoing torsional deformation.

Moreover, the horizontal rib e2 forming the upper corner reinforcing member E1 is arranged in a substantially collinear manner with respect to the upper horizontal rib 3e1" of the horizontal portion included in the fitting block member 3e. Thus, the container C1 formed into a box shape can be increased in strength and rigidity and prevented from undergoing torsional deformation.

Furthermore, the horizontal rib e2 forming the upper corner reinforcing member E1 is arranged in a substantially collinear manner with respect to the upper horizontal rib 3e1" of the horizontal portion included in the fitting block member 3e. Thus, the fitting block members 3e formed on the short wall member 3 can be increased in strength and rigidity.

The appropriate number of horizontal ribs 3h formed on the outer wall surface 3a1 of the short wall member 3 is arranged in a substantially collinear manner with respect to the upper horizontal rib 3e1" of the horizontal portion 3e1 included in the fitting block member 3e. This configuration enables the short wall member 3 and thus the container C1 assembled into a box shape to be increased in strength and rigidity. Moreover, the container C1 can be prevented from undergoing torsional deformation. Furthermore, the fitting block members 3e formed on the short wall member 3 can be increased in strength and rigidity.

If the appropriate number of horizontal ribs 3h formed on the outer wall surface 3a1 of the short wall member 3 are not provided at the positions of the upper horizontal ribs 3e1" of the horizontal portions 3e1 included in the fitting block members 3e, corner horizontal reinforcing ribs 3m are each formed in a corner formed by the endwise vertical side plate portion 3d and the outer surface 3a1 of the flat plate portion 3a. Each of the corner horizontal reinforcing ribs 3m is arranged in a substantially collinear manner with respect to the upper the upper horizontal rib 3e1" of the horizontal portion 3e1 included in the corresponding fitting block member 3e. This configuration enables the short wall member 3 and thus the container C1 assembled into a box shape to be increased in strength and rigidity. Moreover, the container C1 can be prevented from undergoing torsional deformation. Furthermore, the fitting block members 3e formed on the short wall member 3 can be increased in strength and rigidity.

Furthermore, the lower-end horizontal flange 3c includes the sub fitting block members B1' suspended from the back surface thereof and fitted into the sub fitting vertical slots h1 formed in the peripheral upper end horizontal flange 1c of the above-described bottom member 1. Thus, since the lower-end horizontal flange 3c includes the sub fitting block members B1' suspended from the back surface thereof and fitted into the sub fitting vertical slots h1 formed in the peripheral upper end horizontal 1c of the above-described bottom member 1, the short wall member 3 can be prevented from being tilted when erected. Triangular reinforcing ribs 3n may be formed in a corner formed by the outer surface 3a1 of the flat plate portion 3a and the lower-end horizontal flange 3c.

Now, assembly of the container C1 will be described with reference to FIG. 19 to FIG. 26.

First, the coupling between the long wall member 2 and the short wall member 3 will be described.

Figure 19:
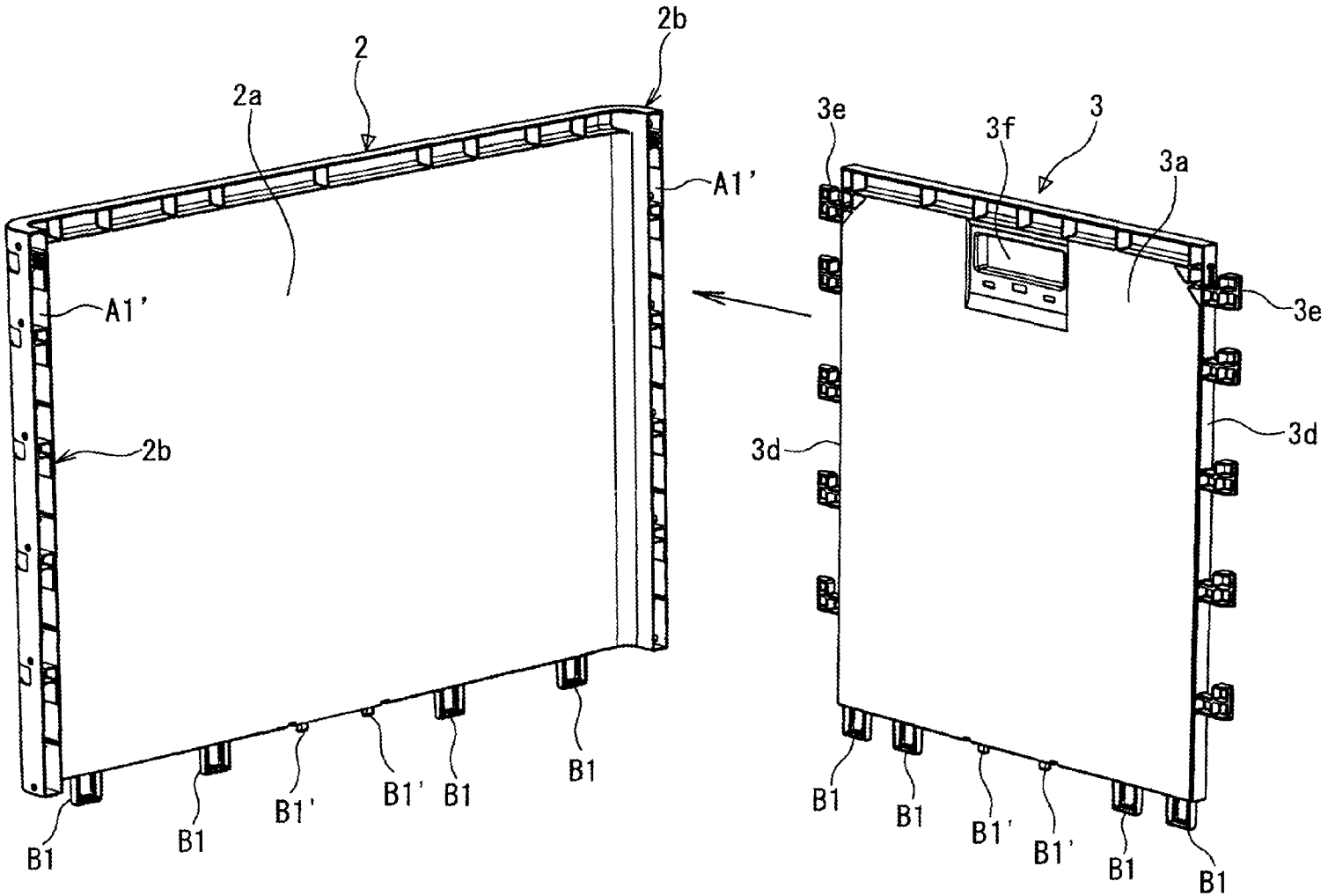
FIG. 19 is a perspective view of the long wall member and the short wall member illustrating the order in which the container according to the present invention is assembled.
Figure 20:
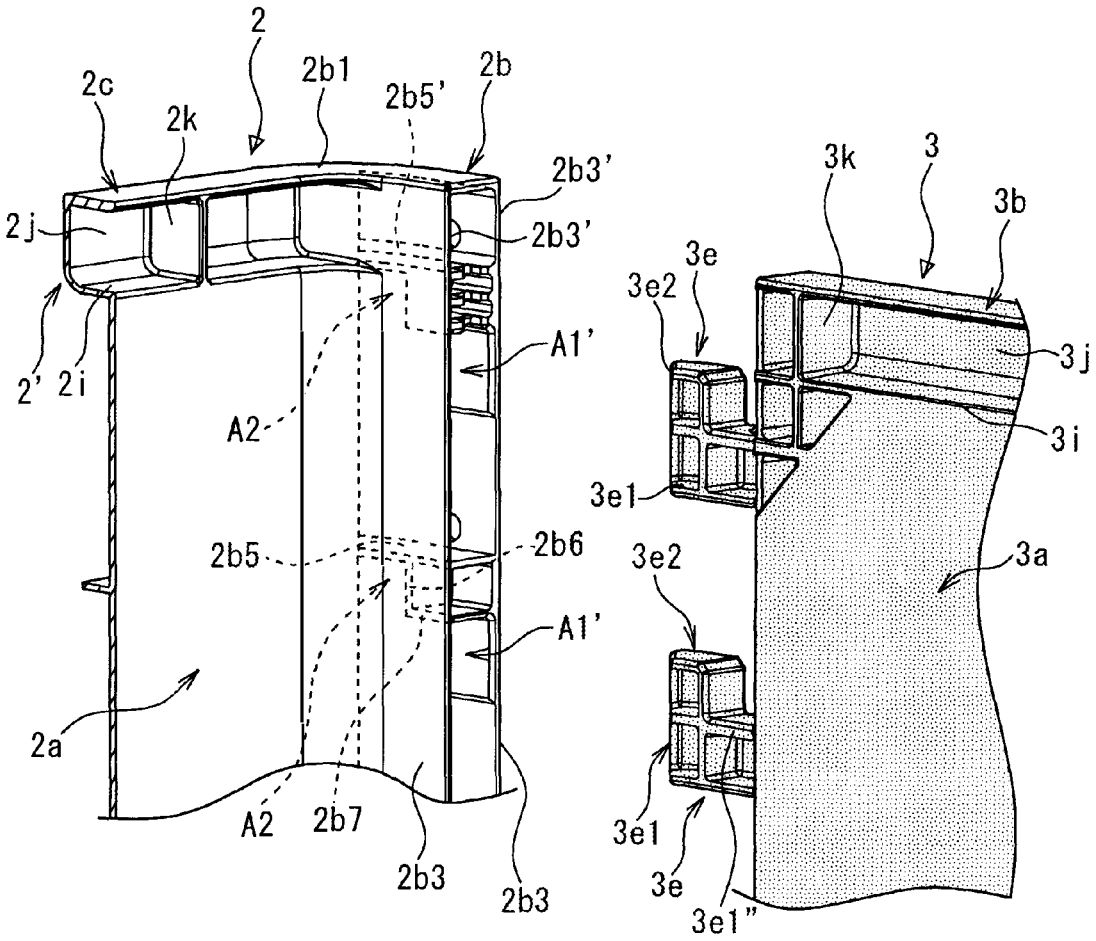
FIG. 20 is a perspective view of the long wall member and the short wall member illustrating the order in which the container according to the present invention is assembled.

As shown in FIG. 19, the long wall member 2 and the short wall member 3 are arranged so that the flat plate portion 2a of the long wall member 2 and the flat plate portion 3a of the short wall member 2 cross at right angles as shown in FIG. 19 and so that the sub space portions A1' formed in the vertically elongate coupling portion 2b of the long wall member 2 lie opposite the respective fitting block members 3e formed on the endwise vertical side plate portions 3d of the short wall member 3 as shown in FIG. 20.

Figure 21:
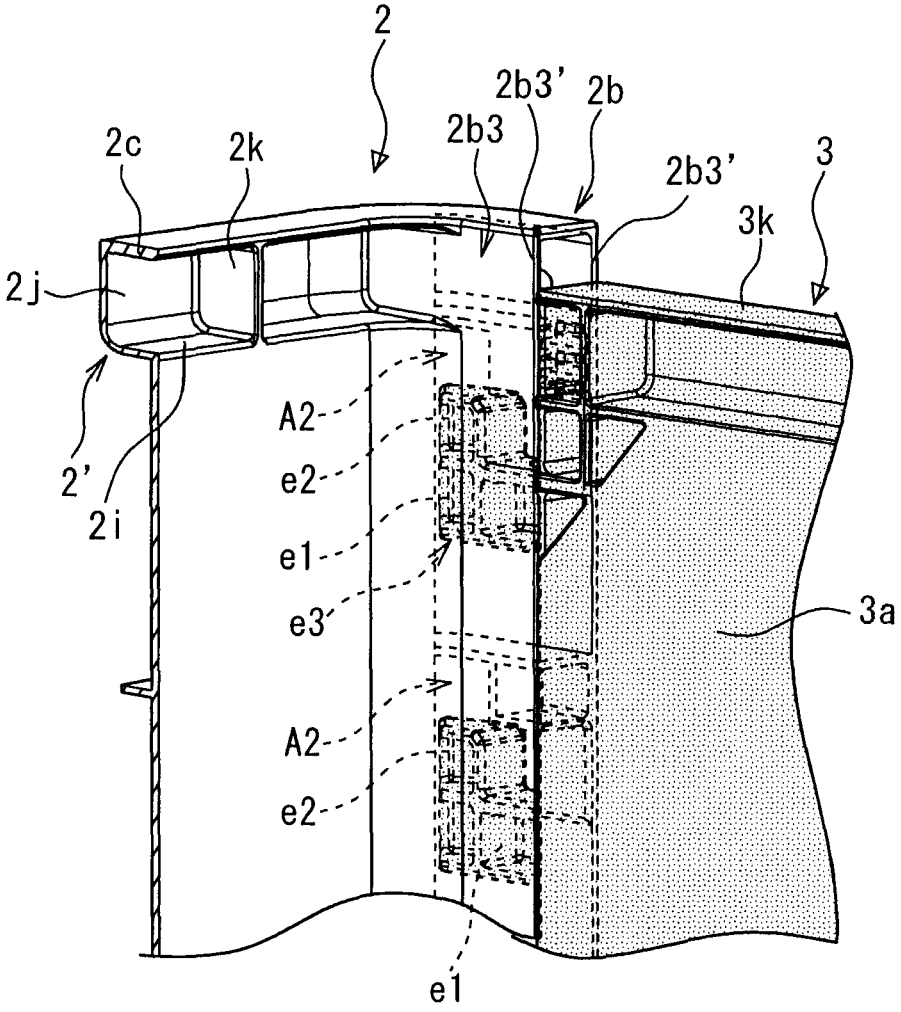
FIG. 21 is also a perspective view of the long wall member and the short wall member illustrating the order in which the container according to the present invention is assembled.
Figure 22:
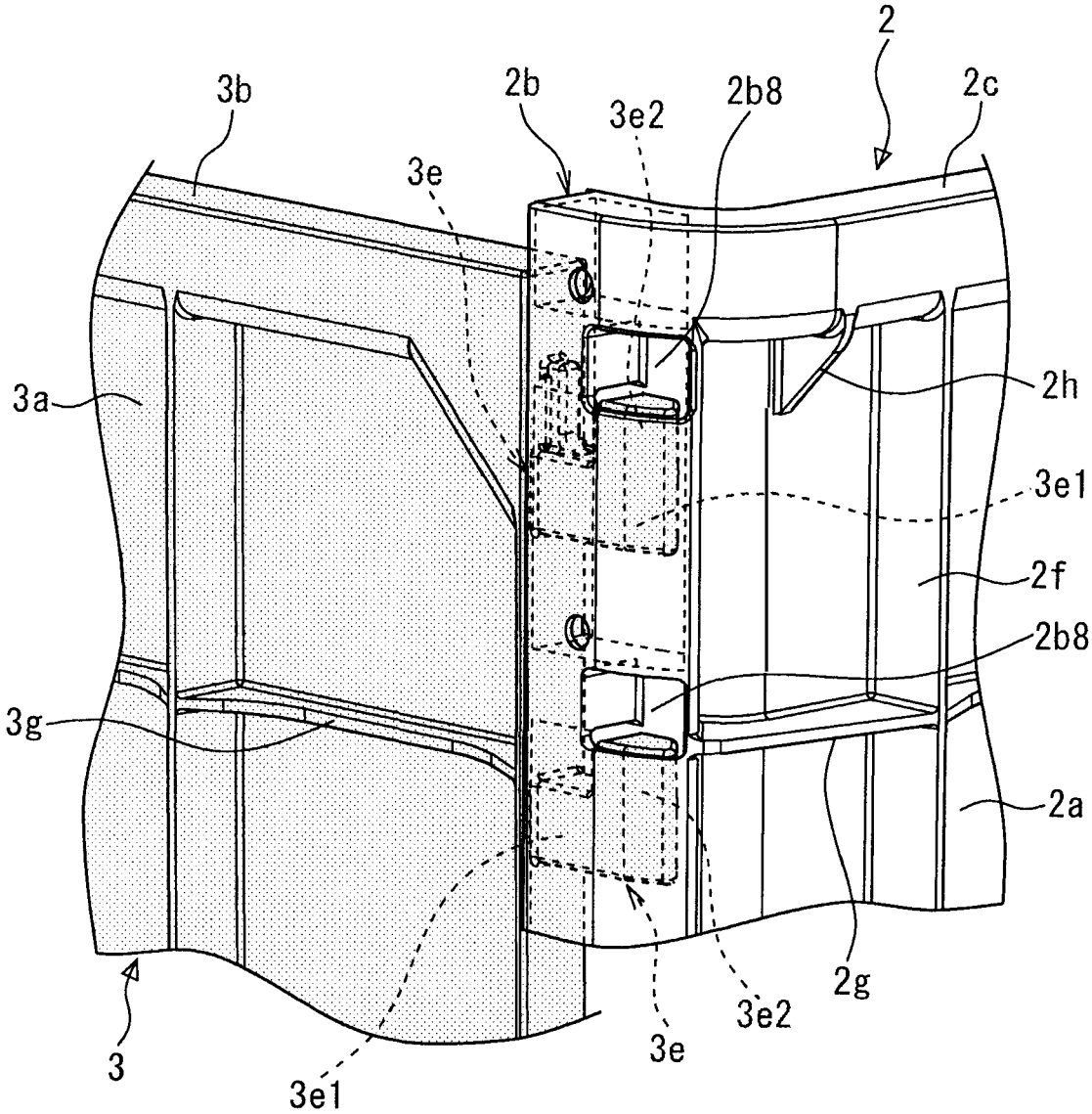
FIG. 22 is also a perspective view of the long wall member and the short wall member illustrating the order in which the container according to the present invention is assembled.

Then, the short wall member 3 is moved closer to the long wall member 2, and fitting block members 3e formed on the endwise vertical side plate portions 3d of the short wall member 3 are inserted into the respective sub space portions A1' formed in the vertically elongate coupling portion 2b of the long wall member 2. Furthermore, as shown in FIG. 21, the endwise vertical side plate portion 3d of the short wall member 3 is brought into abutting contact with the tip 2b3' of the opposite vertical side plate portion 2b3 included in the vertically elongate coupling portion 2b of the long wall member 2. When the endwise vertical side plate portion 3d of the short wall member 3 thus comes into abutting contact with the tip 2b3' of the opposite vertical side plate portion 2b3 included in the vertically elongate coupling portion 2b of the long wall member 2, the vertical portions 3e2 of the fitting block members 3e formed in the short wall member 3 are positioned under the respective fitting spaces A2 positioned in the sub space portions A1' formed in the vertically elongate coupling portion 2b of the long wall portion 2. Hence, whether or not the vertical portions 3e2 of the fitting block members 3e formed in the short wall member 3 are positioned under the respective fitting spaces A2 formed in the vertically elongate coupling portion 2b of the long wall portion 2 can be checked through the viewing through-slots 2b8 depending on whether or not the vertical portions 3e2 of the fitting block members 3e are positioned in the respective viewing through-slots 2b8 drilled in one of the opposite vertical side plate portions 2b3 forming the vertically elongate coupling portion 2b which is positioned outside, as shown in FIG. 22.

Figure 23:
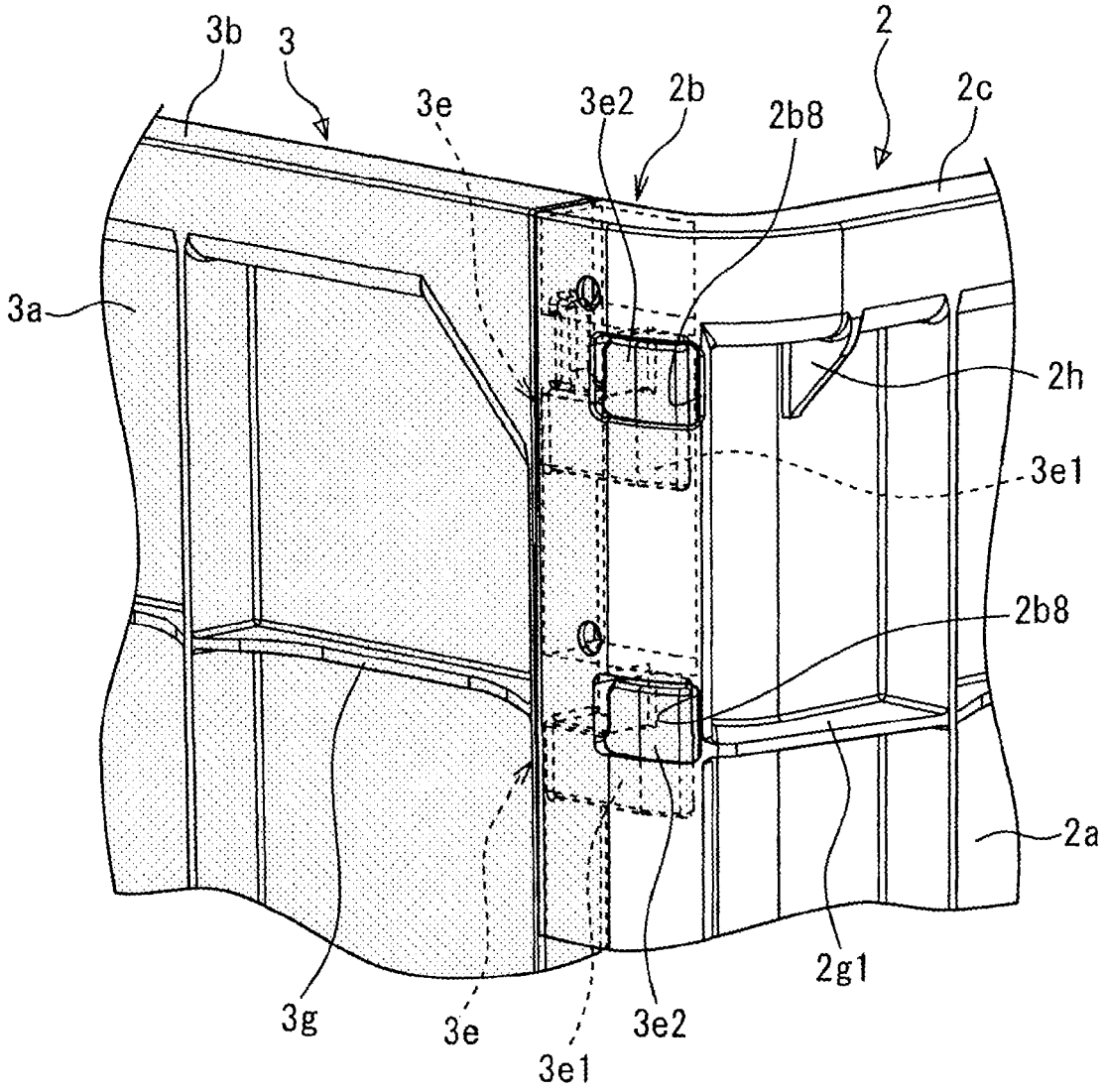
FIG. 23 is also a perspective view of the long wall member and the short wall member illustrating the order in which the container according to the present invention is assembled.
Figure 24:
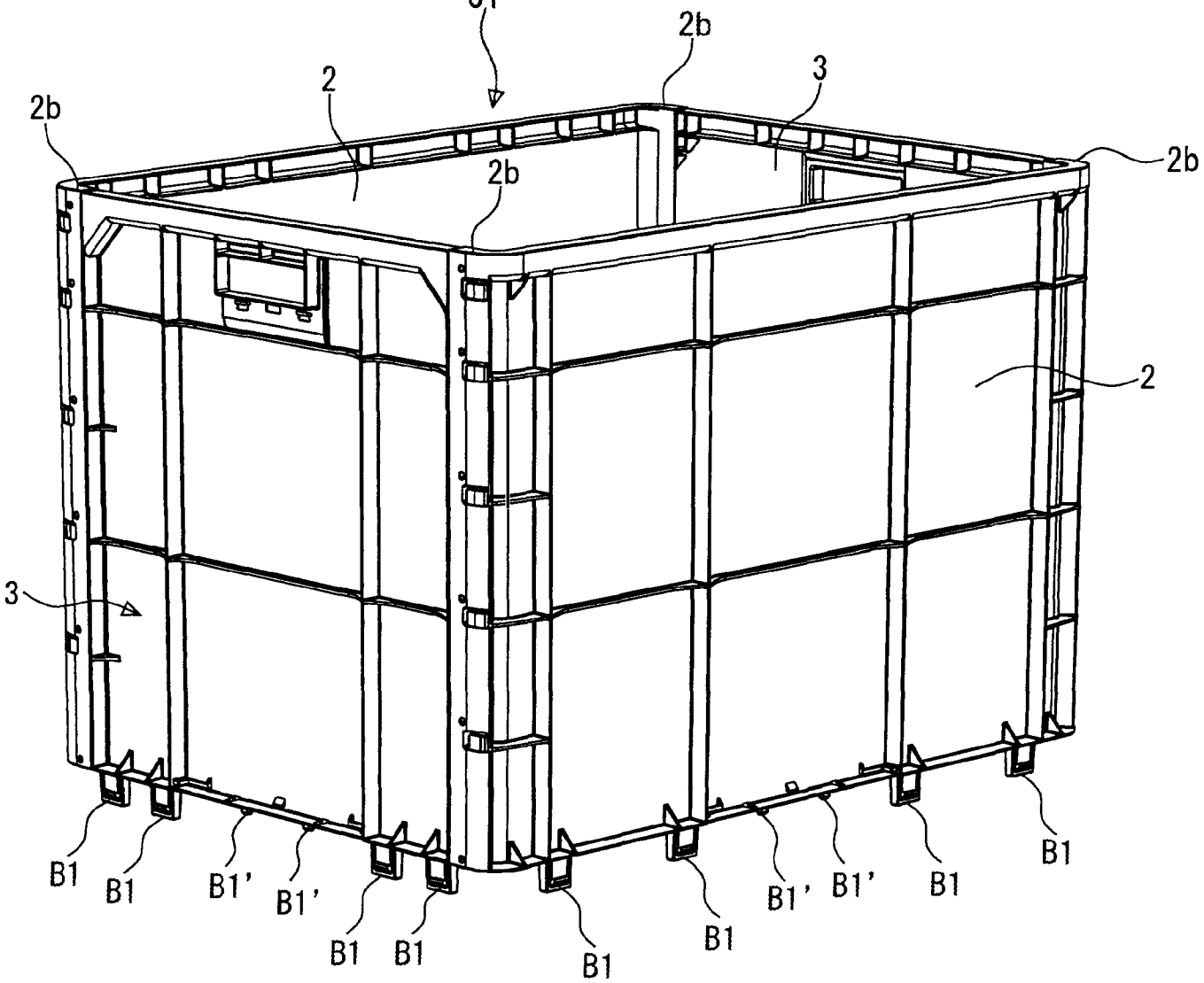
FIG. 24 is a perspective view of a container main body included in the container according to the present invention.

Then, the short wall member 3 is raised with respect to the long wall member 2 or the long wall member 2 is lowered with respect to the short wall member 3 to fit the vertical portions 3e2 of the fitting block members 3e formed on the short wall member 3 into the respective sub spaces A2 positioned in the sub space portions A1' formed in the vertically elongate coupling portion 2b of the long wall member 2 as shown in FIG. 23. When the vertical portions 3e2 of the fitting block members 3e are thus fitted into the respective fitting spaces A2, the upper surfaces of the horizontal portions 3e1 of the fitting block members 3e come into abutting contact with the respective lower surfaces of the horizontal pieces 2b7 positioned under the horizontal partitioning plate portions 2b5 and 2b5', and the upper surface of the upper-end horizontal flange 2c of the long wall member 2 is set flush with the upper surface of the upper-end horizontal flange 3b of the short wall member 3. In this manner, the long wall member 2 and the short wall member 3 are coupled together. Alternatively, the upper surface of the upper-end horizontal flange 2c of the long wall member 2 may be positioned slightly above the upper surface of the upper-end horizontal flange 3b of the short wall member 3.

As described above, when the long wall member 2 and the short wall member 3 are coupled together as described above, the vertical portions 3e2 of the fitting block members 3e2 formed on the short wall member 3 are fitted into the respective fitting spaces A2 positioned in the sub space portions A1' formed in the vertically elongate coupling portion 2b of the long wall member 2. Thus, if a load acting in a direction in which the long wall member 2 and the short wall member 3 are separated from each other is placed on the long wall member 2 and the short wall member 3, the vertical portions 3e2 of the fitting block members 3e come into abutting contact with the vertical pieces 2b6 forming the fitting spaces A2.

Consequently, the long wall member 2 and the short wall member 3 can be prevented from being separated from each other.

As described above, when the long wall member 2 and the short wall member 3 are coupled together, the upper horizontal ribs 3*e*1" of the horizontal portions 3*e*1 of the fitting block members 3*e* formed on the short wall member 3 are arranged in a substantially collinear manner with respect to the respective high portions 2*g*1 of the horizontal ribs 2*g* formed on the long wall member 2. This configuration allows an increase in the strength and rigidity of the container main body C1' obtained by assembling the pair of opposite long wall members 2 and the pair of opposite short wall members 3 together and thus in the strength and rigidity of the container main body C1' and the container C1.

Figure 25:
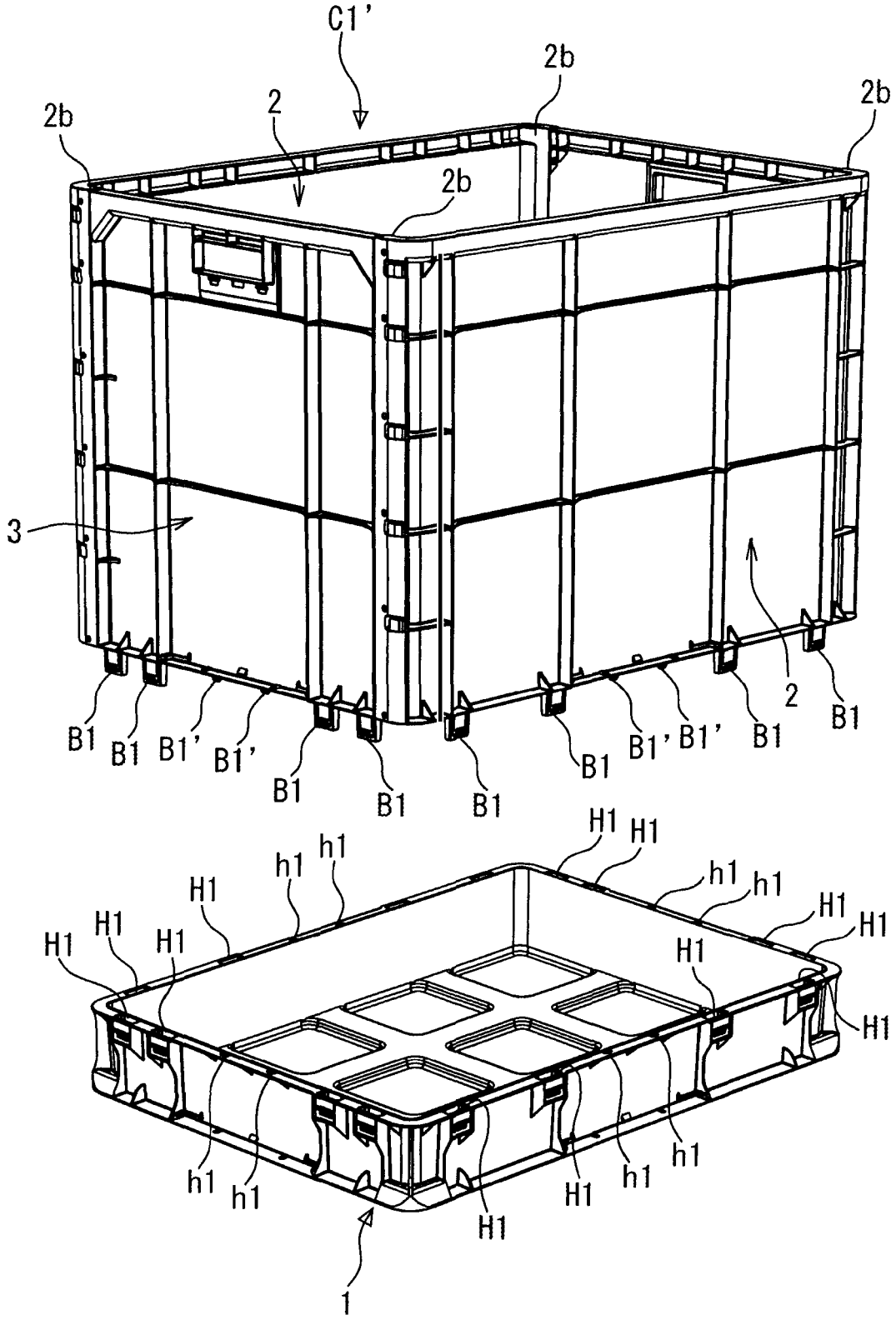
FIG. 25 is a perspective view of the container main body and the bottom member both included in the container according to the present invention.
Figure 26:
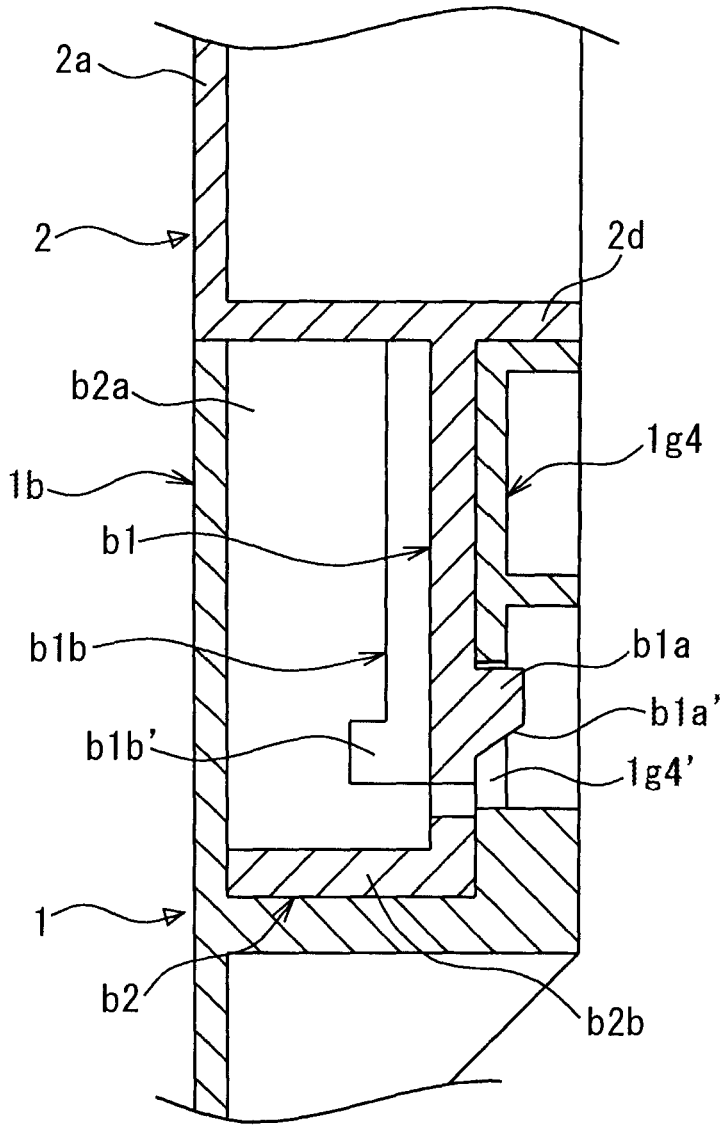
FIG. 26 is a partly enlarged vertical cross-sectional view showing that the container main body and the bottom member forming the container according to the present invention have been fitted together.

The container main body C1' obtained by assembling the pair of opposite long wall members 2 and the pair of opposite short wall members 3 together is placed above the bottom member 1 as shown in FIG. 25. Thereafter, the container main body C1' is moved closer to the bottom member 1, and the fitting blocks formed on the long wall member 2 and the fitting blocks B1 formed on the short wall members 3 are inserted into the fitting vertical slots H1 in the fitting members 1*g* formed on the bottom member 1. During the process of inserting the fitting blocks B1 into the fitting vertical slots H1, the inclined surface b1*a*' of the locking projecting portion b1*a* formed on the elastic tongue piece b1 protected by the elastic tongue piece protecting member b2 included in each of the fitting blocks B1 come into abutting contact with the corresponding one of the opposite sides 1*g*1' forming the fitting hole 1*g*1 in the fitting member 1*g* and extending along the longitudinal direction of the peripheral upper-end horizontal flange 1*c* which side 1*g*1' is positioned closer to the tip of the peripheral upper-end horizontal flange 1*c*. The free end of the elastic tongue piece b1 is elastically deformed toward the peripheral wall portion 1*b*, and the fitting blocks B1 formed on the long wall members 2 and the short wall members 3 are fitted into the respective fitting vertical slots H1 in the fitting members 1*g* formed on the bottom member 1. Once the locking projecting portion b1*a* formed on the elastic tongue piece b1 aligns with the corresponding locking through-slot 1*g*4' drilled in the partitioning plate portion 1*g*4 included in each of the fitting members 1*g* formed on the bottom member 1, the elastically deformed elastic tongue piece b1 recovers its original vertical state, and as shown in FIG. 26, the locking projecting portion b1*a* is inserted into the corresponding locking through-slot 1*g*4' drilled in the partitioning plate portion 1*g*4. Thus, the bottom member 1 is coupled to the long wall members 2 and the short wall members 3, and the container C1 according to the present invention is assembled.

Furthermore, when the sub fitting block members B1' as described above are suspended from the back surface of the lower-end horizontal flange 2*d* of the long wall member 2 and/or the back surface of the lower-end horizontal flange 3*c* of the short wall member 3, the sub fitting block members B1' are fitted into the respective sub fitting vertical slots h1 formed in the peripheral upper-end horizontal flange 1*c* of the bottom member 1.

As described above, the long wall member 2 includes the vertically elongate coupling portions 2*b* formed to extend from the opposite vertical sides of the flat plate portion 2*a* substantially perpendicularly to the inner surface 2*a*1 of the flat plate portion 2*a*. Thus, the long wall members 2 and the container C1 formed into a box shape can be increased in strength and rigidity. Therefore, the container C1 assembled into a box shape can be prevented from undergoing torsional deformation.

Furthermore, as described above, during the operation of coupling the bottom member 1 to the long wall members 2 and the short wall members 3, the fitting blocks B1 formed on each of the long wall members 2 and the fitting blocks B1 formed on each of the short wall members 3 are inserted into the respective fitting vertical slots H1 in the fitting members 1*g* formed on the bottom member 1. In this case, since the elastic tongue piece b1 included in each of the fitting blocks B1 is protected by the corresponding elastic tongue piece protecting member b2 at the lower end thereof, the elastic tongue piece b1 is prevented from coming into direct abutting contact with the peripheral upper-end horizontal flange 1*c* of the bottom member 1. Therefore, during the operation of coupling the bottom member 1 to the long wall members 2 and the short wall members 3, the elastic tongue pieces b1 can be prevented from being damaged.

Figure 27:
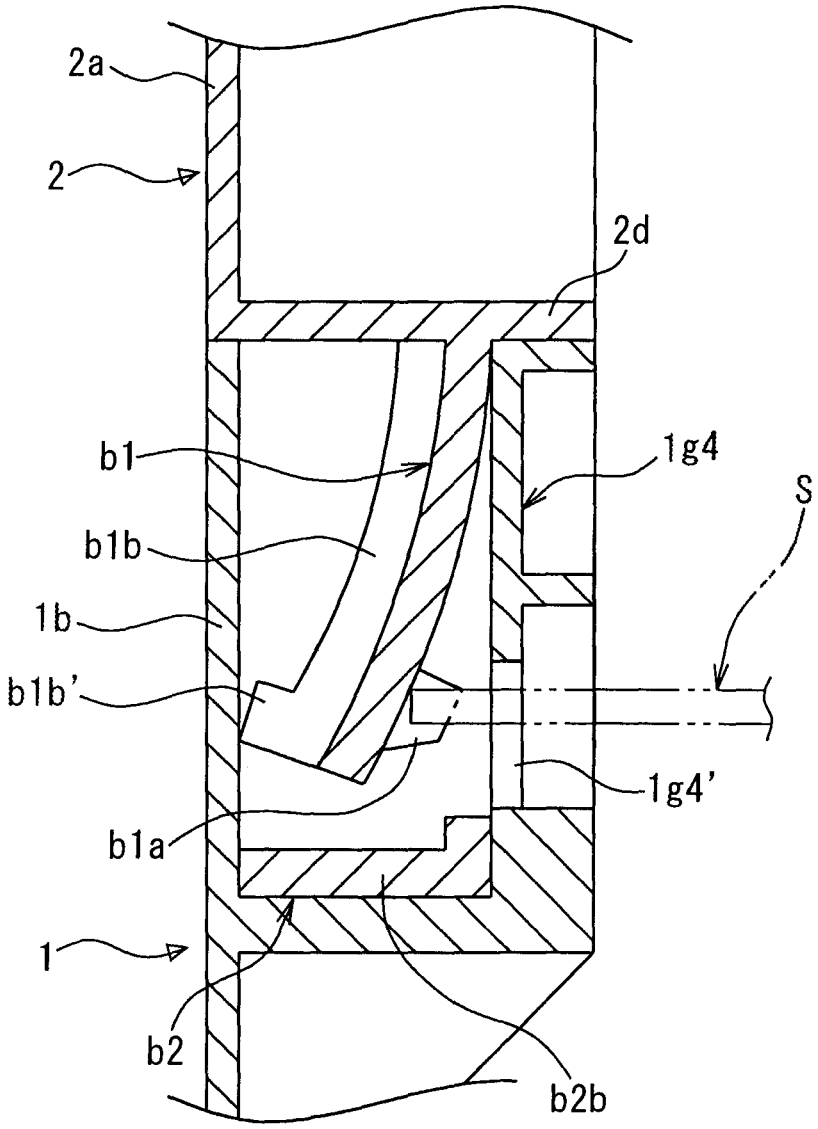
FIG. 27 is a partly enlarged vertical cross-sectional view showing how the container main body and the bottom member forming the container according to the present invention and fitted together are released from each other.

The container C1 assembled into a box shape is disassembled as follows. First, a bar member S is inserted into the recessed portion b1*a*" formed in the locking projecting portion b1*a* of the elastic tongue piece b1 included in each of the fitting block members B1 formed on the long wall members 2 and the short wall members 3. Thus, as shown in FIG. 27, the free end of the elastic tongue piece b1 is elastically deformed toward the peripheral wall portion 1*b* of the bottom member 1 to discharge the locking projecting portion b1*a* formed on the elastic tongue piece b1 from the corresponding locking through-slot 1*g*4' drilled in the partitioning plate portion 1*g*4 included in each of the fitting members 1*g* formed on the bottom member 1. Thereafter, the container main body C1' is raised to decouple the container main body C1' from the bottom member 1. To achieve the operation of decoupling the container main body C1' from the bottom member 1, the free end of the elastic tongue piece b1 is elastically deformed toward the peripheral wall portion 1*b* of the bottom member 1. However, the elastic tongue piece b1 is prevented from being excessively elastically deformed and damaged because the elastic deformation suppressing projection b1*b*' is projected from the elastic tongue piece b1 as described above and brought into abutting contact with the peripheral wall portion 1*b* of the bottom member 1 as shown in FIG. 27.

The disassembling operation for the long wall members 2 and the short wall members 3 forming the container main body C1' can be achieved by reversing the steps of the assembling operation for the long wall members 2 and the short wall members 3. That is, the short wall member 3 is lowered with respect to the long wall member 2 or the long wall member 2 is raised with respect to the short wall member 3 to discharge the vertical portions 3*e*2 of the fitting block members 3*e* formed on the short wall member 3 from the respective fitting spaces A2 positioned in the sub space portions A1' formed in the vertically elongate coupling portion 2*b* of the long wall member 2. Thereafter, the fitting block members 3*e* of the short wall member 2 are pulled out from the respective sub space portions A1' of the long wall member 2. As a result, the long wall member 2 and the short wall member 3 can be disassembled from each other. In this manner, the container C1 is disassembled into five members, that is, the one bottom member 1, the two long wall members 2, and the two short wall members 3.

The embodiment has been described as follows. The container C1 includes five members, that is, the one bottom member 1, the two long wall members 2, and the two short wall members 3. First, the two long wall members and the two short wall members 3 are assembled to form the cylindrical container main body C1'. Thereafter, the cylindrical container main body C1' is coupled to the bottom member 1 to obtain the container C1 assembled into a box shape. Furthermore, the cylindrical container main body C1' is pulled out from the bottom member 1 of the container C1 assembled into a box shape. Then, the long wall members 2 are disengaged from the short wall members 3. As a result, the container C1 can be disassembled into five members, that is, the one bottom member 1, the two long wall members 2, and the two short wall members 3. Therefore, the container C1 can be assembled and disassembled quickly and easily.

Furthermore, the container C1 includes five members, that is, the one bottom member 1, the two long wall members 2, and the two short wall members 3. Thus, a space required to store the disassembled members 1, 2, and 3 can be significantly reduced compared to a space required to store the container C1.

Additionally, to change the long wall members 2-side width of the container C1 by increasing or reducing the width of each of the long wall members 2 of the container C1, the width of the long wall member 2 and the width of each of the long-side peripheral walls 1*b*1 of the peripheral wall portion 1*b* included in the bottom member 1 may be simply changed. The short wall members 3 need not be changed.

Furthermore, as shown in FIG. 14 to FIG. 17, at a corner formed by each of the endwise vertical side plate portions 3*d* of the short wall member 3 and the upper horizontal rib 3*e*1" of the horizontal portion 3*e*1 of the fitting block member 3*e*, a vertical fitting protrusion 3*p* is formed which extends from the upper horizontal rib 3*e*1" to the vicinity of the upper horizontal flange 3*i*.

On the other hand, a recessed portion 2*m* into which the above-described vertical fitting protrusion 3*p* can be fitted is formed in the horizontal piece 2*b*7 formed on the vertically elongate coupling portion 2*b* of the long wall member 2 and extending to the upper-end horizontal partitioning plate portion 2*b*5' lying opposite the upper-end horizontal plate portion 2*b*1 and to the tip 2*b*3' of the opposite vertical side plate portion 2*b*3. Thus, when the container C1 is assembled into a box shape, the fitting protrusions 3*p* formed on the short wall member 3 are fitted into the respective recessed portions 2*m* formed in the vertically elongate coupling portion 2*b* of the long wall member 2. Then, the short wall member 3 can be more reliably restrained from moving in the vertical direction with respect to the flat plate portion 2*a* of the long wall member 2. Furthermore, the long wall members 2 and short wall members 3 of the container C1 assembled into a box shape can be more reliably prevented from undergoing torsional deformation.

As described above, the upper corner reinforcing member E1 is formed at the corner formed by the upper horizontal flange 3*i* and endwise vertical side plate portion 3*d* of the short wall member 3; the upper corner reinforcing member E1 includes the inclined coupling rib e1 coupling the vicinity of the end of the upper horizontal flange 3*i* to the vicinity of the upper end of the endwise vertical side plate portion 3*d*, the horizontal rib e2 formed in the middle of the inclined coupling rib e1 to couple the inclined coupling rib e1 to the endwise vertical side plate portion 3*d* of the short wall member 3, the vertical rib e3 connected to the vertical reinforcing coupling rib 3*k* coupling the upper-end horizontal flange 3*b* and upper horizontal flange 3*i* of the short wall member 3 together, and the corner outer-wall plate portion e4. Thus, the short wall members 3 and the container C1 formed into a box shape can be increased in strength and rigidity. Furthermore, the container C1 can be prevented from undergoing torsional deformation.

Additionally, the horizontal rib e2 of the upper corner reinforcing member E1 is arranged in a substantially collinear manner with respect to the upper horizontal rib 3*e*1" of the horizontal portion 3*e*1 included in the fitting block member 3*e*. Thus, the upper corner reinforcing member E1 can further be reinforced, and the container C1 formed into a box shape can be increased in strength and rigidity. Furthermore, the container C1 can be prevented from undergoing torsional deformation. The fitting block members 3*e* can also be increased in strength and rigidity.

Moreover, the vertical rib e3 is connected via the upper horizontal flange 3*i* to the vertical reinforcing coupling rib 3*k* coupling the upper horizontal flange 3*b* to the upper horizontal flange 3*i*. This configuration allows the short wall members 3 and the container C1 formed into a box shape to be increased in strength and rigidity. Furthermore, the container C1 can be prevented from undergoing torsional deformation.

Moreover, the horizontal rib 3*h* is arranged in a substantially collinear manner with respect to the upper horizontal rib 3*e*1" of the horizontal portion 3*e*1 included in the fitting block member 3*e*. This configuration allows the short wall members 3 and the container C1 formed into a box shape to be increased in strength and rigidity. Furthermore, the container C1 can be prevented from undergoing torsional deformation. The fitting block members 3*e* formed on the short wall member 3 can also be increased in strength and rigidity.

Moreover, when the long wall member 2 and the short wall member 3 are coupled together, the upper horizontal rib 3*e*1" of the horizontal portion 3*e*1 of each of the fitting block members 3*e* formed on the short wall member 3 is arranged in a substantially collinear manner with respect to the high portion 2*g*1 of the corresponding one of the horizontal ribs 2*g* formed on the long wall member 2. This configuration enables an increase in the strength and rigidity of the container main body C1' obtained by assembling the pair of opposite long wall members 2 and the pair of opposite short wall members 3 together. Furthermore, the container main body C1' and the container C1 can be increased in strength and rigidity.

I claim:

1. An assemblable and disassemblable container, comprising:

one bottom member including fitting vertical slots formed therein, a set of two first wall members, each of said first wall members including fitting space portions formed in vertically elongate coupling portions and including fitting block members suspended from a back surface of a lower-end horizontal flange, a set of two second wall members, each of said second wall members including fitting blocks formed on endwise vertical side plate portions and including fitting block members suspended from a back surface of a lower-end horizontal flange, wherein the container is assemblable such that the two first wall members lie opposite each other and such that the two second wall members lie opposite each other, by fitting said fitting blocks of the second wall members into said respective fitting space portions of the first wall members, wherein the container is assemblable such that the first wall members and the second wall members are each coupled to the bottom member by fitting said fitting block members of the first wall members and fitting said block members of the second wall members into said respective fitting vertical slots of the bottom member, wherein each of the second wall members include upper corner reinforcing members formed at corresponding corners formed by an upper horizontal flange and the endwise vertical side plate portions of the second wall members, wherein the upper corner reinforcing members each include an inclined coupling rib coupling the vicinity of an end of the upper horizontal flange to the vicinity of the upper end of a corresponding one of the endwise vertical side plate portions, an uppermost end of the inclined coupling rib being coupled to the upper horizontal flange and a lowermost end of the inclined coupling rib being coupled to the endwise vertical plate portion, wherein the lower end of the inclined coupling rib is positioned close to an endwise vertical side plate portion side of a lower horizontal rib of a horizontal portion included in the fitting block member, and wherein each of said fitting blocks suspended from the back surface of the first wall members and the second wall members comprises an elastic tongue piece projecting from the lower-end horizontal flange, and an elastic tongue piece protecting member projecting from the lower-end horizontal flange, the elastic tongue piece being spaced from said elastic tongue piece and surrounding side surfaces and a lower surface of said elastic tongue piece.

2. The assemblable and disassemblable container according to claim 1, wherein said fitting block members of said second wall members include vertical portions, and wherein when the first wall members and the second wall members are coupled together, said vertical portions of the second wall members are fitted into the respective fitting spaces of the first wall members.

3. The assemblable and disassemblable container according to claim 1, wherein the lower-end horizontal flange of the first wall members and the lower-end horizontal flange of the second wall members comprise the fitting blocks suspended from the back surface thereof, wherein said bottom member includes fitting members, each of said fitting members having a vertical slot and a locking through member, and wherein when the first wall members and the second wall members are coupled to the bottom member, the locking projecting portions of said fitting blocks of the first wall members and said second wall members are fitted and locked in corresponding locking through-slots of said fitting members formed on the bottom member.

4. The assemblable and disassemblable container according to claim 1, wherein the elastic tongue piece includes a locking projection portion projecting in a first direction from the elastic tongue piece, and an elastic deformation suppression portion projecting in a second direction from the elastic tongue piece, opposite the first direction.

5. The assemblable and disassemblable container according to claim 4, wherein the locking projection portion protrudes beyond the elastic tongue piece protecting member, in the first direction, and wherein the elastic deformation suppression portion does not protrude beyond the elastic tongue piece protecting member, in the second direction.

* * * * *